US009068312B1

(12) United States Patent
Happel

(10) Patent No.: US 9,068,312 B1
(45) **Date of Patent: *Jun. 30, 2015**

(54) ROTATABLE WHEEL BOX SERVICE PANEL DOOR AND EQUALIZER AND METHOD

(71) Applicant: Tom Happel, Cocoa, FL (US)

(72) Inventor: Tom Happel, Cocoa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/151,284

(22) Filed: Jan. 9, 2014

Related U.S. Application Data

(60) Division of application No. 13/846,145, filed on Mar. 18, 2013, now Pat. No. 8,651,767, which is a division of application No. 12/823,727, filed on Jun. 25, 2010, now Pat. No. 8,425,150, which is a continuation-in-part of application No. 12/533,806, filed on Jul. 31, 2009, now Pat. No. 8,393,827.

(51) Int. Cl.
*E02B 7/28* (2006.01)

(52) U.S. Cl.
CPC ..... *E02B 7/28* (2013.01)

(58) Field of Classification Search
USPC ..... 405/36, 80, 87, 90, 103–106; 251/326, 251/204; 49/209, 216, 218, 219; 210/162, 210/170.03; 137/630, 630.12
See application file for complete search history.

(56) References Cited

U.S. PATENT DOCUMENTS

| | | | |
|---|---|---|---|
| 2,360,961 | A | 10/1944 | Mayo |
| 3,237,915 | A | 3/1966 | Palmer |
| 4,278,190 | A | 7/1981 | Oory |
| 6,270,663 | B1 | 8/2001 | Happel |
| 6,428,692 | B2 | 8/2002 | Happel |

(Continued)

FOREIGN PATENT DOCUMENTS

JP 2004353407 * 12/2004

OTHER PUBLICATIONS

Rising and Non-Rising Stern, Telescoping Valves, Halliday Products, 4 pgs, online, retrieved on Jun. 15, 2009, retrieved from www.hallidayproducts.com/ssq.html.

(Continued)

*Primary Examiner* — Sean Andrish
(74) *Attorney, Agent, or Firm* — Brian S. Steinberger; Law Offices of Brian S. Steinberger, P.A.

(57) ABSTRACT

Systems, devices, apparatus, and methods of locking and unlocking a door that is slidable by articulating wheels in tracks, over an entry port to a storm water structure. Locking the door can be accomplished by rotating bolts that are attached to cams. Rotating the bolts causes the cams to press the door against the tracks. Sealing strips can be compressed between door edges and the track to prevent water from passing around the door. A vacuum truck can remove water and debris from the vault/structure. Other versions allow doors to move downward to allow water to overflow the door. The door can slide upward so water can flow underneath. A door in door version has a secondary door slide up and down in tracks in a main door.

17 Claims, 22 Drawing Sheets

(56) References Cited

U.S. PATENT DOCUMENTS

| | | | | |
|---|---|---|---|---|
| 6,797,162 | B2 | 9/2004 | Happel | |
| 6,869,525 | B1 | 3/2005 | Happel | |
| 6,979,148 | B2 | 12/2005 | Happel | |
| 7,153,417 | B2 | 12/2006 | Happel | |
| 7,270,747 | B2 | 9/2007 | Happel | |
| 7,294,256 | B2 | 11/2007 | Happel | |
| 7,785,464 | B2 | 8/2010 | Happel | |
| 7,846,327 | B2 | 12/2010 | Happel | |
| 8,622,652 | B1 * | 1/2014 | Happel | 405/104 |
| 2003/0026659 | A1 * | 2/2003 | Wu | 405/87 |

OTHER PUBLICATIONS

Aluminum Slide and Weird Glass, Water and Waste Water Valves and Gates, 10 pages, online, retrieved on Jun. 15, 2009, retrieved from www.//ncvg.netproducts/alumSlideWeir.html.

* cited by examiner 380
350
340
330
120
200
80
90

330
50
120
90
40
180
80
40
320

380
330
350
340
200
80
90

50
330
120
90
40
180
80
40
320

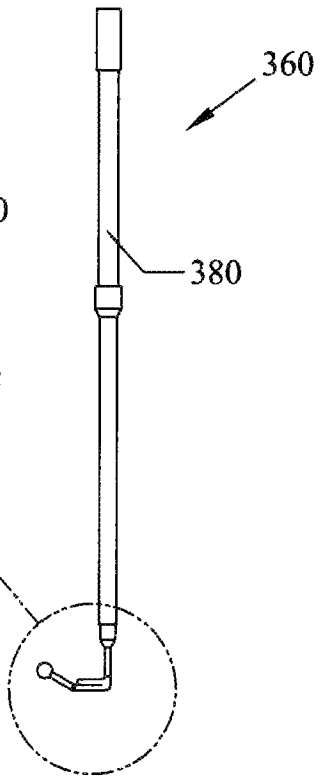
Fig.29
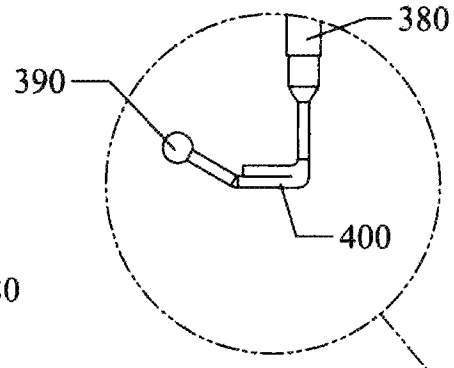
Fig.29 A
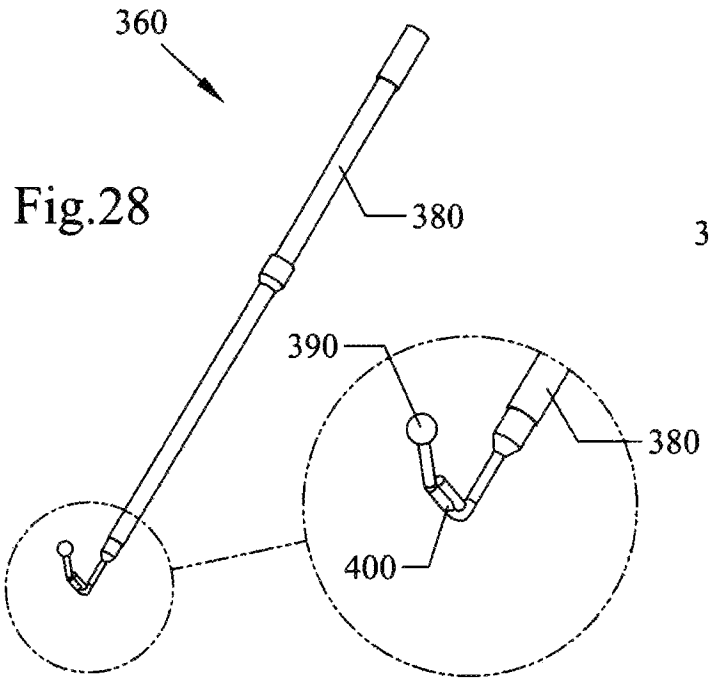
Fig.28 A
Fig.28

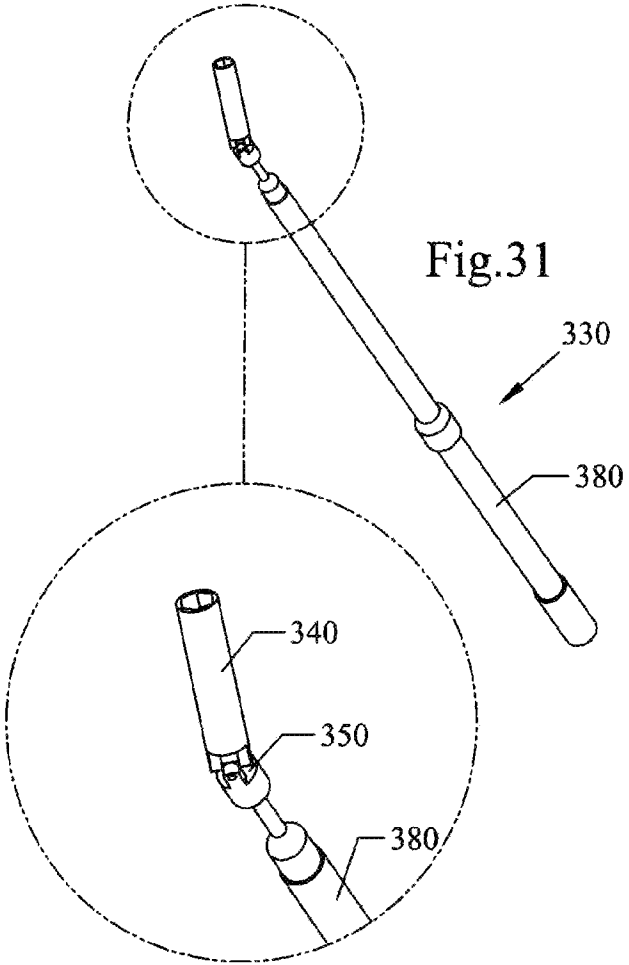
Fig.31
Fig.31 A
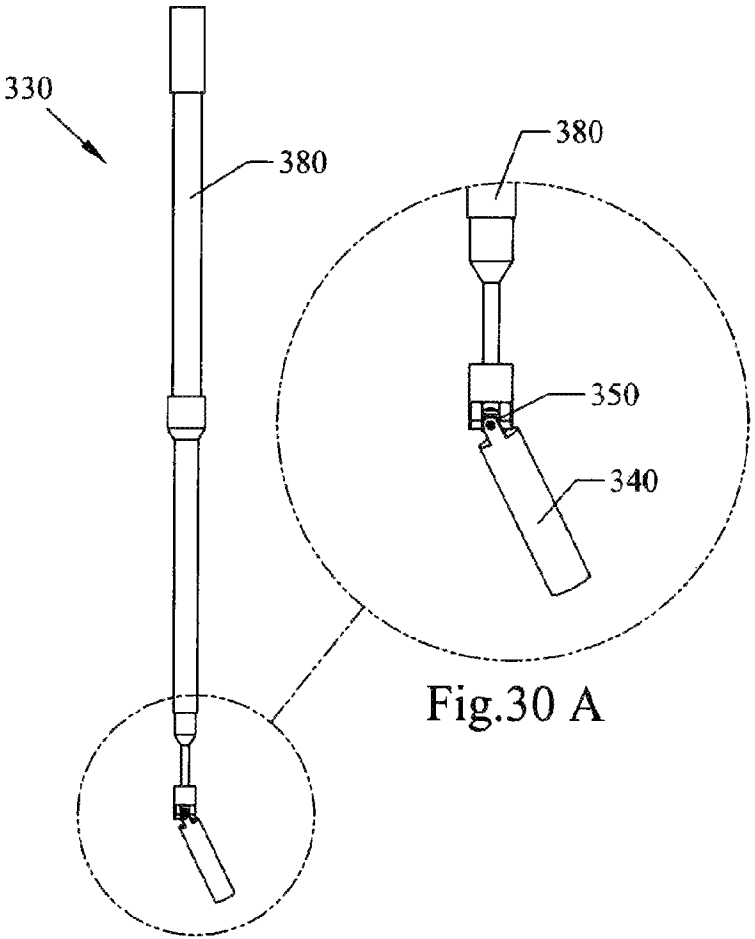
Fig.30
Fig.30 A

ROTATABLE WHEEL BOX SERVICE PANEL DOOR AND EQUALIZER AND METHOD

This application is a Divisional patent application of Ser. No. 13/846,145 filed Mar. 18, 2013, now U.S. Pat. No. 8,651, 767 which is a Divisional patent application of Ser. No. 12/823,727 filed Jun. 25, 2010, now U.S. Pat. No. 8,425,150, which is a Continuation-In-Part of U.S. patent application Ser. No. 12/533,806 filed Jul. 31, 2009, now U.S. Pat. No. 8,393,827. The entire disclosure of each of the applications listed in this paragraph are incorporated herein by specific reference thereto.

FIELD OF THE INVENTION

This invention relates to water damper controls for storm water treatment systems, manmade ponds and pools, natural lakes, ponds, actuaries and other water ways, and in particular to devices, apparatus, systems and methods of using a damper panel system to isolate a water treatment control structure from unwanted water inflow where a slidable door on wheels can be sealed in place with rotatable cams pushing one side of the door against portions of the tracks, so that operators can unlock the sealed door and pull out the door by hand when needed, where the door can slide upward to different height positions, and slide downward to different height position.

BACKGROUND AND PRIOR ART

There are federal clean water requirements that require water bodies such as lakes and rivers must meet strict minimal water quality specifications. To achieve these requirements, stormwater drainage pipes often require treatment before conveying stormwater into receiving water bodies. As a result, a wide variety of technologies have been developed to treat stormwater and improve the water quality. A common variety of stormwater treatment systems are hydrodynamic separators such as baffle type boxes and vortex systems. However, over time stormwater treatment systems often will fill with collected debris and will require service to remove the collected debris.

The servicing of a stormwater treatment structure typically requires the use of a vacuum truck that will suck out the collected solids and water within the structure. After the vacuum truck removes the debris and water from the stormwater structure, the vacuum truck transfers those contents to a processing facility for proper disposal. However, servicing stormwater structures is often complicated by unwanted water flow running into the stormwater structures during the service procedure. This unwanted water flow typically originates from high water levels in lakes and rivers adjacent to the treatment structure, or from an upstream base flow.

While the vacuum truck is removing water and debris from the treatment structure, water sometimes continues to flow in. Often the amount of water flowing into the treatment structure during servicing exceeds the rate at which the vacuum truck can remove the water. Having water enter the stormwater structure during servicing procedure reduces the effectiveness and efficiency of the service procedure and results with having the vacuum truck to dispose of additional water.

There have been attempts over the years to try to use various damper or gate type systems, such as the aluminum slide and weir gates manufactured by Northcoast Valve & Gate Inc., and slide gates manufactured by Halliday Products Inc. The common problem with damper or gate systems used in the prior art is that they are either difficult to install and use, or they leak badly. Additionally, these gates are too heavy and cumbersome for a single person to unlock and lift, and instead usually require two or more persons to operate which adds extra expenses and time.

Thus, the need exists for solutions to the above problems with the prior art.

SUMMARY OF THE INVENTION

A primary objective of the present invention is to provide devices, apparatus, systems and methods of using a damper system to isolate waterways, such as storm water treatment systems, manmade ponds and pools, natural lakes, ponds, actuaries and other water ways from unwanted water inflow so that gates can be easily opened when needed.

A secondary objective of the present invention is to provide devices, apparatus, systems and methods of using a damper system in a storm water treatment systems, manmade ponds and pools, natural lakes, ponds, actuaries and other water ways, that will reduce service treatment time and increase the effectiveness of services which will improve the removal efficiency of treatment systems and reduce servicing costs.

A third objective of the present invention is to provide devices, apparatus, systems and methods of using a damper system in a storm water treatment systems, manmade ponds and pools, natural lakes, ponds, actuaries and other water ways, that are easy to install and use, and will not leak.

A fourth objective of the present invention is to provide devices, apparatus, systems and methods of using a damper system in a storm water treatment systems, manmade ponds and pools, natural lakes, ponds, actuaries and other water ways, that can be used by a single person to lock and unlock.

A fifth objective of the present invention is to provide devices, apparatus, systems and methods of using a damper system in a storm water treatment systems, manmade ponds and pools, natural lakes, ponds, actuaries and other water ways, using wheels that dramatically reduce friction to allow the door to be lifted and removed by a single person.

The novel damper system can include a track that attaches to the inside wall of a separator that is used in storm water treatment systems, manmade ponds and pools, natural lakes, ponds, actuaries and other water ways, with a damper panel that rotatably slides in place.

The external housing of the stormwater vault or treatment structure is commonly made of concrete, fiberglass, or plastic. The damper system track can be installed so that it makes a kind of frame around the inflow and/or outflow pipes and is attached to the inside surface of the treatment structure. A track system can be ideally sized to accommodate the damper panel.

The damper panel can be made of metal, fiberglass, or plastic, combinations thereof, and the like, and can have a cam system mechanism along the vertical edges of the panel on one side. On the other side of the panel a rubber seal is continuous along the edge of the panel, going down one side, then across the bottom, and then up the other side. When the damper panel is lowered into the track system to block the pipe it is very loose and does not bind along the track system. When the cams are rotated the mechanism can then force the panel to wedge into the track and compress the rubber seal along the inside surface of the track. Once the cams have wedged the damper panel in place and the rubber seal is compressed against the track, the panel is locked in place and it will not leak water from the pipe into the stormwater vault.

The cams can be rotated to either lock the damper panel in place or release the damper panel. The cams can be either rotated by a lever attached to the top of the cam system, or a wrench, or other tools such as but not limited to pliers, pipes, and the like. The wrench can be either hand held or socket attached to the end of a hand held pole. The advantage of attaching the socket to the end of a long pole is that a person does not need to enter the vault to rotate the cams.

The damper panel can have a special lifting point attachment that allows the panel to be lowered into the track system without having to enter the vault. The lifting point would have a slot that would sized to receive an approximately 1" diameter ball such as a metal sphere attached to the end of a thin rod, and the rod would be attached to a hand held pole. The damper panel would hang vertically on the end of the hand held pole and the geometry of the sphere in the slot would allow the damper panel to freely articulate on the end of the pole without binding. By this method the damper panel can be easily lowered into the vault and placed into the damper track.

A plurality of wheels on each side of the panel assembly can allow for the panel assembly to easily ride up and down in the tracks.

The separate rotatable cams in each of the tracks can be replaced by single elongated cams that can have paddle or wedge shapes. Alternatively, the invention can use removable wedges that when driven into place compress and water seal the damper panel in place.

A preferred embodiment of a damper system for storm water treatment vault structures, can include a frame attached to an inner wall of a vault structure, the frame having an opening therethrough, tracks attached to the frame about the opening, a door having wheels along outer side edges, the wheels of the door being slidably received within the tracks, the door having an open position for allowing water to flow into the vault structure and a closed position for preventing water from passing into the vault structure, and moveable members along one side face of the door for pushing the door against portions of the track to seal the door against water intrusion.

The moveable members can include rotatable cams along perimeters of side edges of the door, the cams having an unlocked position where the door is loosely seated in the tracks and a locked position where the door is pushed against one side of the tracks, wherein the locked position prevents water from passing about edges of the door.

The removable tool can be a hand wrench for rotating the cams from the unlocked to the locked position. The removable tool can be a socket wrench for rotating the cams from the unlocked to the locked position.

The moveable members can be a single elongated rotatable cam on each side edge of the door. Alternatively, the moveable members can include a plurality of rotatable cams on each side edge of the door.

Elongated seal members between perimeter edges of the door and the one side of the track, can be used wherein the cams in the locked position cause the door to compress the elongated sealing members against the one side of the track so that water is sealed and prevented from entering about the edges of the door.

A handle can be attached to the door for raising and lowering the door. An elongated tool having an end portion can attach to and detach to the handle. The elongated tool can have a hook end, wherein lifting the handle raises the door from the tracks, and allows the storm water to enter into the vault structure.

A preferred method of locking and unlocking slidable doors in a storm water vault structure in order to service the vault structure, can include the steps of providing a door having wheels on sides of the door, sliding the wheels within tracks against an inlet wall of a storm water structure, providing the sides of the door with rotatable cams, locking the door in the tracks by rotating the rotatable cams so that the cams push one side of the door against a portion of the tracks, and unlocking the door rotating the rotatable cams in a counter direction so that the door against loosely sits in the tracks.

The method can further include the steps of providing elongated gasket members along side edges of the door, and sealing the door against the tracks by the locking of the door which compresses the elongated gasket members.

The method can further include the step of removing storm water in the vault structure after the door is sealed in place with a vacuum truck before physically servicing the interior of the vault structure.

The method can further include the step of selectively locking the door in a lower position wherein water flows over the door. The method can further include the step of selectively locking the door in an upper position wherein water flows under the door.

Another embodiment of the damper system for storm water treatment vault structures, can include a frame attached to an inner wall of a vault structure, the frame having an opening therethrough, tracks attached to the frame about the opening, a slidable door having outer side edges being slidably received within the tracks, the slidable door having a lower position for allowing water to flow over the door into the vault structure and an upper position for allowing the water to flow under the door into the vault structure, and the door having closed position for preventing the water from flowing into the vault, and a member for raising and lowering and closing the slidable door.

The system can include rollers on each of the side edges of the slidable door. The system can include cams for locking the door into different height positions within the tracks.

The slidable door can include a door in door version with a primary door that slides in tracks, and a secondary door smaller than the primary door, the secondary door slides up and down in tracks on the primary door.

Further objects and advantages of this invention will be apparent from the following detailed description of the presently preferred embodiments which are illustrated schematically in the accompanying drawings.

BRIEF DESCRIPTION OF THE FIGURES

FIG. 28 is a perspective view of a hook tool used in FIG. 24.

FIG. 28A is an enlarged view of the hook end and ball on the hook tool of FIG. 28.

FIG. 29 is a side view of hook tool of FIG. 28.

FIG. 29A is an enlarged view of the hook end and ball on the hook tool of FIG. 29.

FIG. 30 is a side view of the remote socket wrench tool used in FIGS. 22, 22A, 23 and 23A.

FIG. 30A is an enlarged view of the socket part of the tool of FIG. 30.

FIG. 31 is a perspective view of the remote socket wrench tool of FIG. 30.

FIG. 31A is an enlarged view of the socket part of the tool of FIG. 31.

DESCRIPTION OF THE PREFERRED EMBODIMENTS

Figure 2:
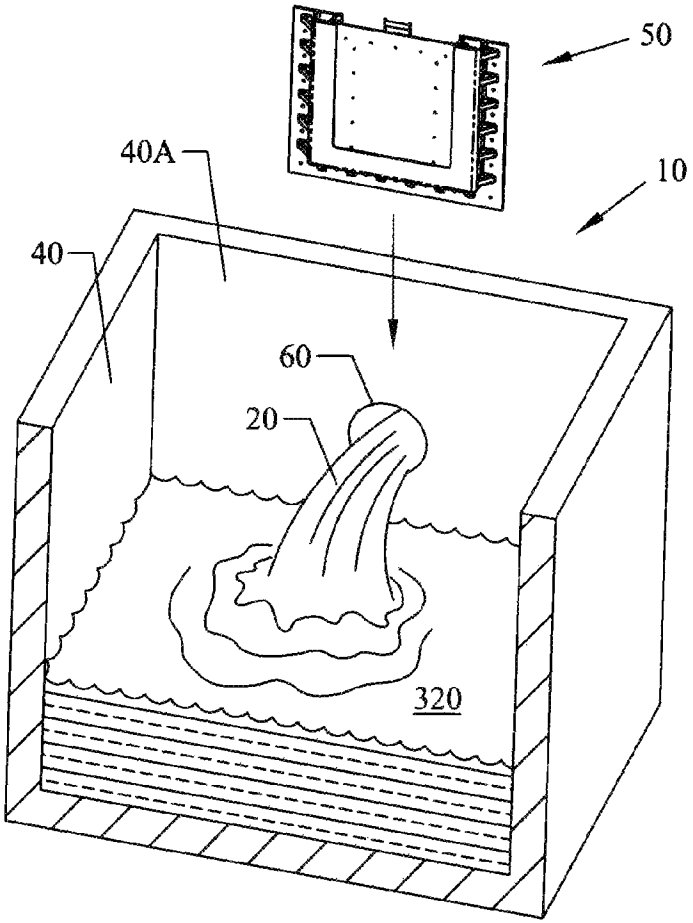
FIG. 2 is a perspective cut-away sectional view of a vault with novel damper system ready to install.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of components will now be described.

10. Concrete storm water handling vault.
20. Storm water inflow.
30. Storm water outflow.
40. Vault wall.
40A. Inner wall
50. Novel damper system with wheels.
60. Vault inlet port/opening.
70. Vault outlet pipe.
80. Composite frame.
90. Novel damper panel assembly.
95. Grooves in side edges of panel 92.
100. Panel lift handle.
110. Front wall of composite frame.
112/114. Parallel tracks with channels 112, 114
112 left channel track of parallel tracks
114 right channel track of parallel tracks
116. Lower channel of front wall.
120. Damper panel release hex.
130. Frame mounting holes.
140. Frame mounting flange.
150. Frame gussets (such as angled strengthening members)
160. Back wall of composite frame.
170. Articulating panel support wheel.
180. Panel.
190. Foam rubber panel seal/gasket members
200. Lock release rod.
210. Damper panel stiffener brace.
220. Damper panel cam-lock.
230. Wheel toggle locking bar.
240. Panel mounted hinge upon which wheel brackets are affixed allow wheels to articulate.
250. Lock release rod mount block.
260. Wheel mount bracket.
270. Stop block prevents cam over-travel in locked or unlocked configuration.
280. Socket wrench tool to lock and unlock panel.
289. Hand wrench
290. Panel cutout to clear support wheel.
300. Water pressure.
310. Cam-lock mounting bar welded to lock release rod.
320. Storm water in vault.
330. wrench tool for remote unlocking of panel assembly.
340. Socket for engaging panel release hex.
350. Universal joint for all-angle operation of remote socket wrench tool.
360. Hook tool for remote lifting of panel assembly.

370. Person.
380. Telescoping tube handle.
390. Ball on hook end to prevent panel lift handle slip.
400. Reinforced lift hook.
590 Door
590B Main (primary) door
590C Track
590D Secondary (smaller) door The subject invention is a Continuation-In-Part of U.S. patent application Ser. No. 12/533,806 filed Jul. 31, 2009, now U.S. Pat. No. 8,393,827, entitled: Box Service Panel Door and Equalizer, which is incorporated by reference.

Figure 1:
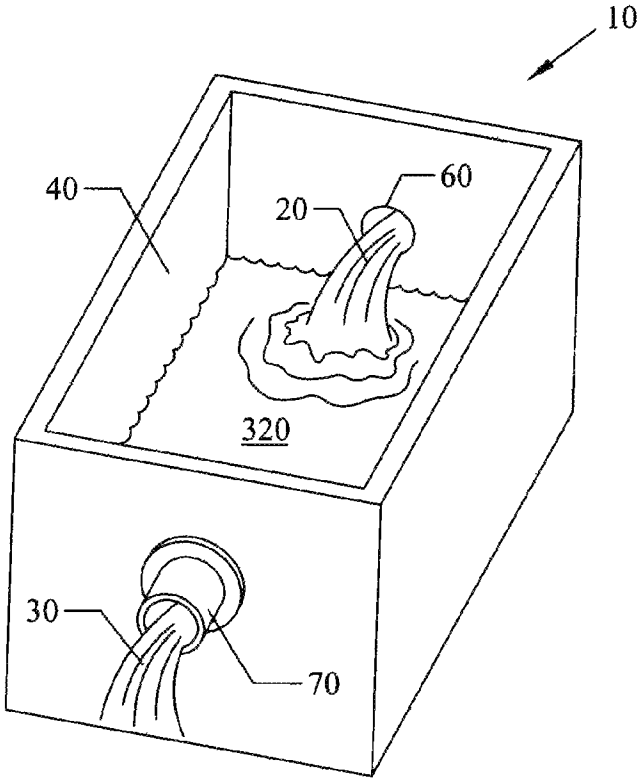
Fig.1 (Prior Art)
FIG. 1 is a top perspective view of a prior art concrete storm water handling vault.

FIG. 1 is a top perspective view of prior art type concrete storm water handling vault 10 that can have four vault walls 40 with storm water 20 inflow coming in through an inlet opening 60 into the vault 10 and eventually flow out 30 through an outlet pipe 70. The external housing of the storm-water vault 10 or treatment structure is commonly made of concrete, fiberglass, or plastic.

Figure 4:
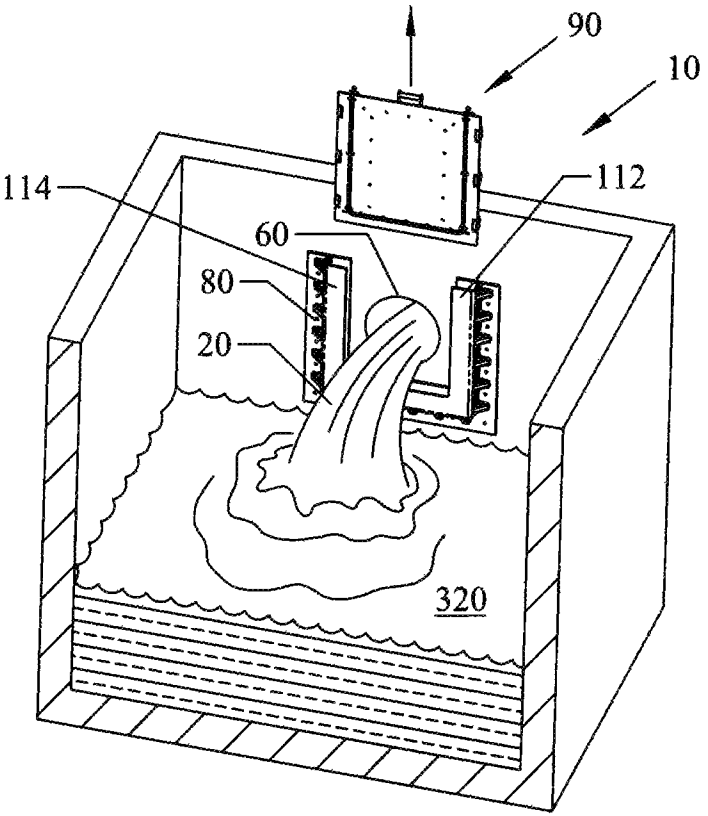
FIG. 4 shows the damper panel assembly removed from the damper frame allowing water to flow.
Figure 3:
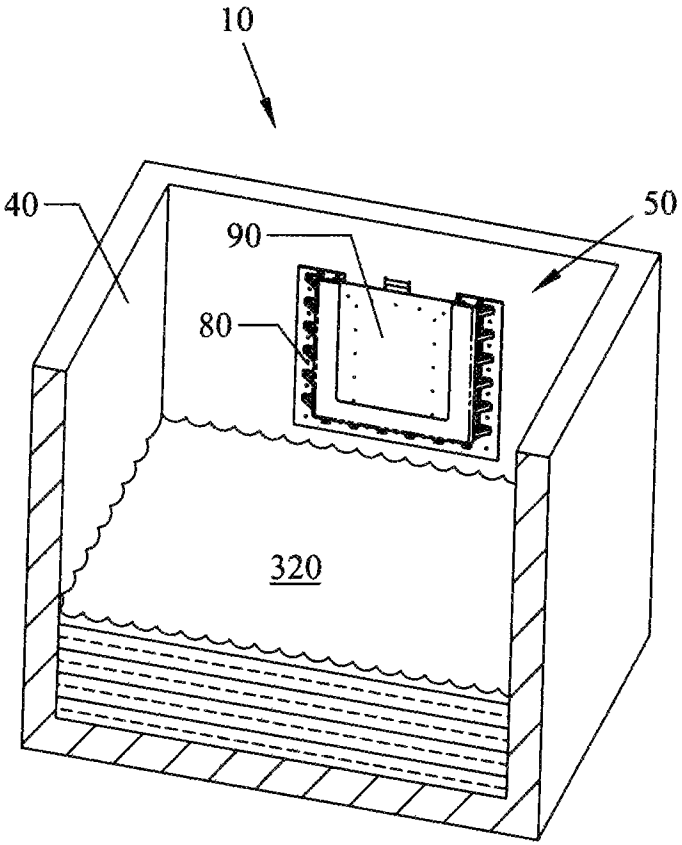
FIG. 3 shows the damper system installed in the vault shutting off water flow.

FIG. 2 is a cut-away perspective section view of the FIG. 1 vault 10 with novel damper system 50 invention ready to be installed to an inner wall 40A over the inlet port 60 to the vault 10. FIG. 3 shows the damper system 50 installed in the vault 10 shutting off water flow with storm water 320 within the vault. FIG. 4 shows the damper panel assembly 90 removed from the damper frame 80 allowing water to flow 20 to flow through vault inlet 60.

The novel damper system 50 can include a composite frame 80 that can attach to the inner surface of the wall 40 about the inlet port 60 by fasteners, such as but not limited to bolts, screws, and the like. Once installed, a damper panel assembly 90 can slide into parallel tracks 112, 114 in the frame 80 to close off the inlet port 60.

Figure 6:
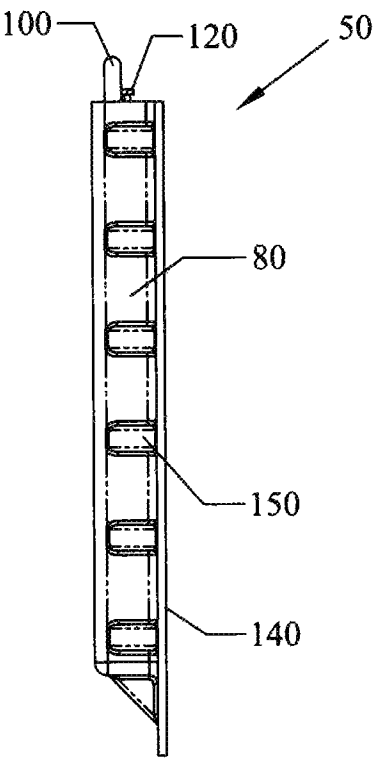
FIG. 6 is a side view of the damper system of FIG. 5.
Figure 5:
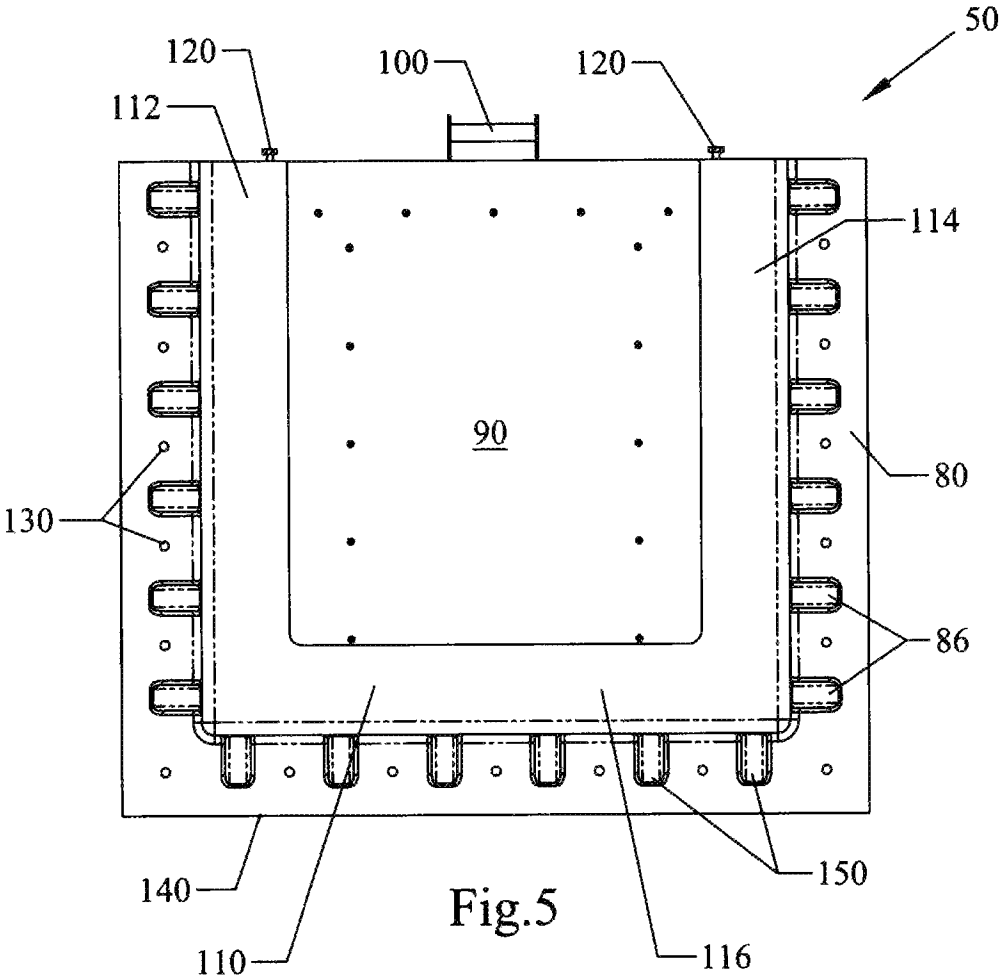
FIG. 5 is a front view of the damper system of FIG. 2.
Figure 8:
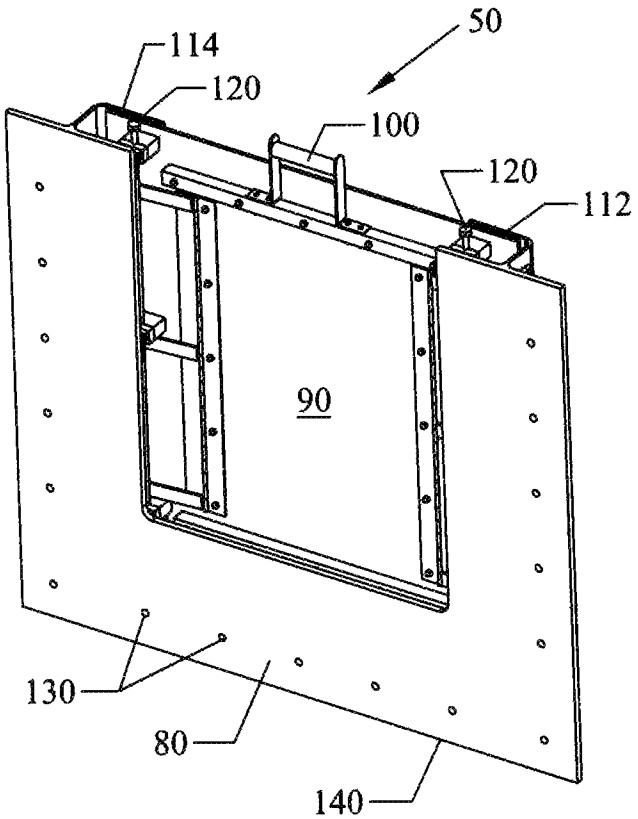
FIG. 8 is a rear perspective view of the damper system of FIG. 5.
Figure 7:
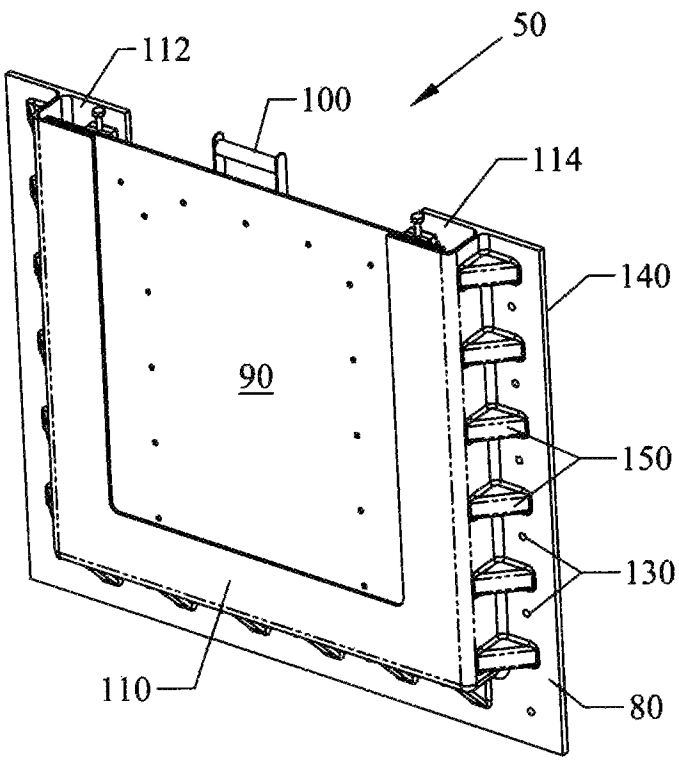
FIG. 7 is a front perspective view of the damper system of FIG. 5.

FIG. 5 is a front view of the damper system 50 of FIG. 2. FIG. 6 is a side view of the damper system 50 of FIG. 5. FIG. 7 is a front perspective view of the damper system 50 of FIG. 5. FIG. 8 is a rear perspective view of the damper system 50 of FIG. 5.

The damper panel assembly 90 can be made from metal such as but not limited to aluminum, galvanized metal, stainless steel, fiberglass, plastic or combinations thereof.

Referring to FIGS. 5-8, frame mounting holes 130 through the U-shaped frame mounted flange 140 of the frame 80 allow for the fasteners to be used to attach the frame 80 to the inner wall 40A of the vault 10. Frame gussets, such as lower angled strengthening members 150 and side angled strengthening members 86 support the U-shaped flange to the parallel tracks with left channel track 112, and right channel track 114. The damper panel 90 can slide along the parallel tracks 112, 114 and sit against a lower channel 116. Across the top of the damper panel assembly 90 is a panel lift handle 100, that can be fastened along bent outer edges by fasteners, such as screws and bolts. The damper panel release hex 120 whose operation of which will be described in greater detail later in reference to FIGS. 14, 15, 18, 19.

Figure 9:
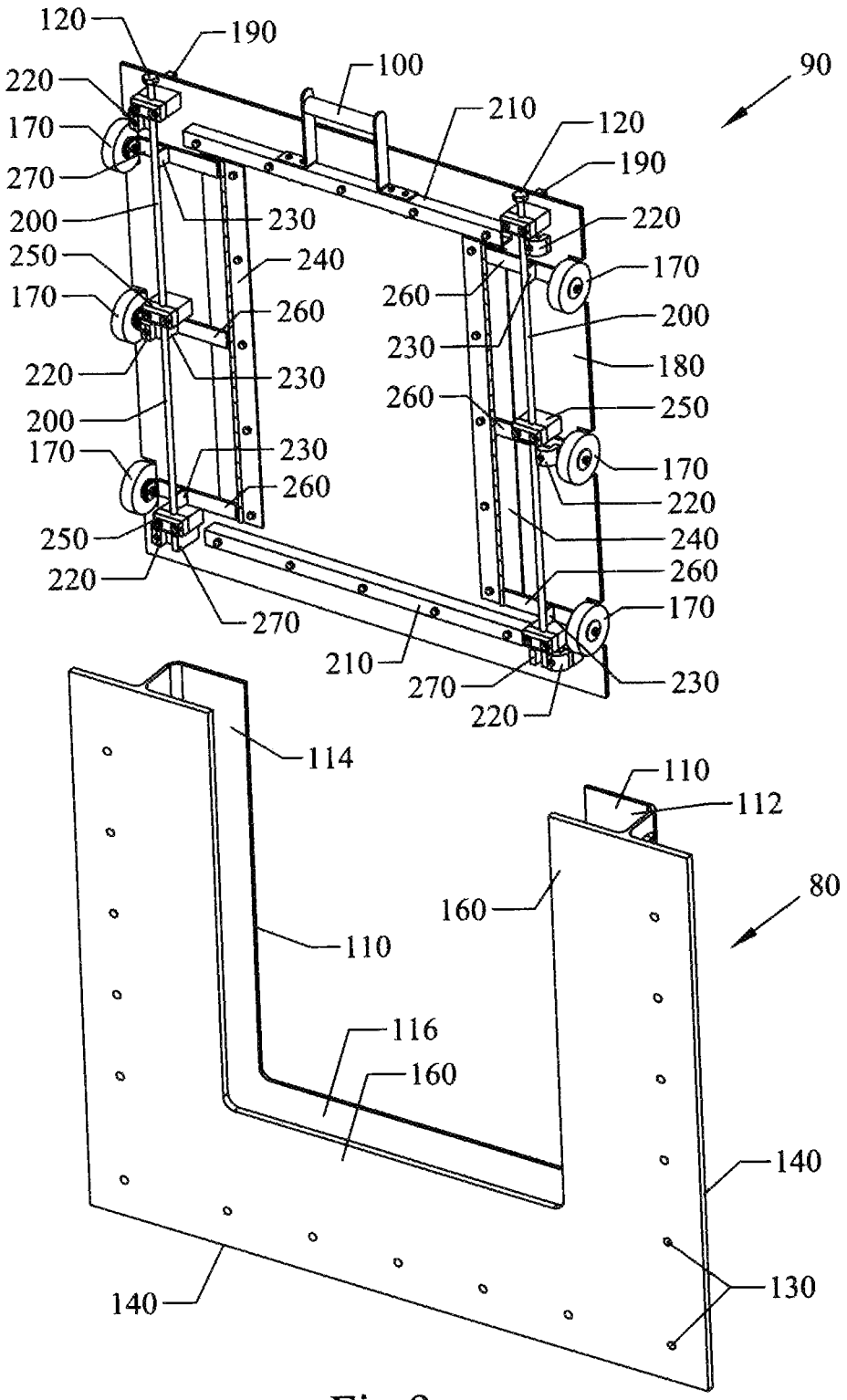
FIG. 9 is a front perspective view of the damper system of FIG. 5 with damper panel removed.
Figure 10:
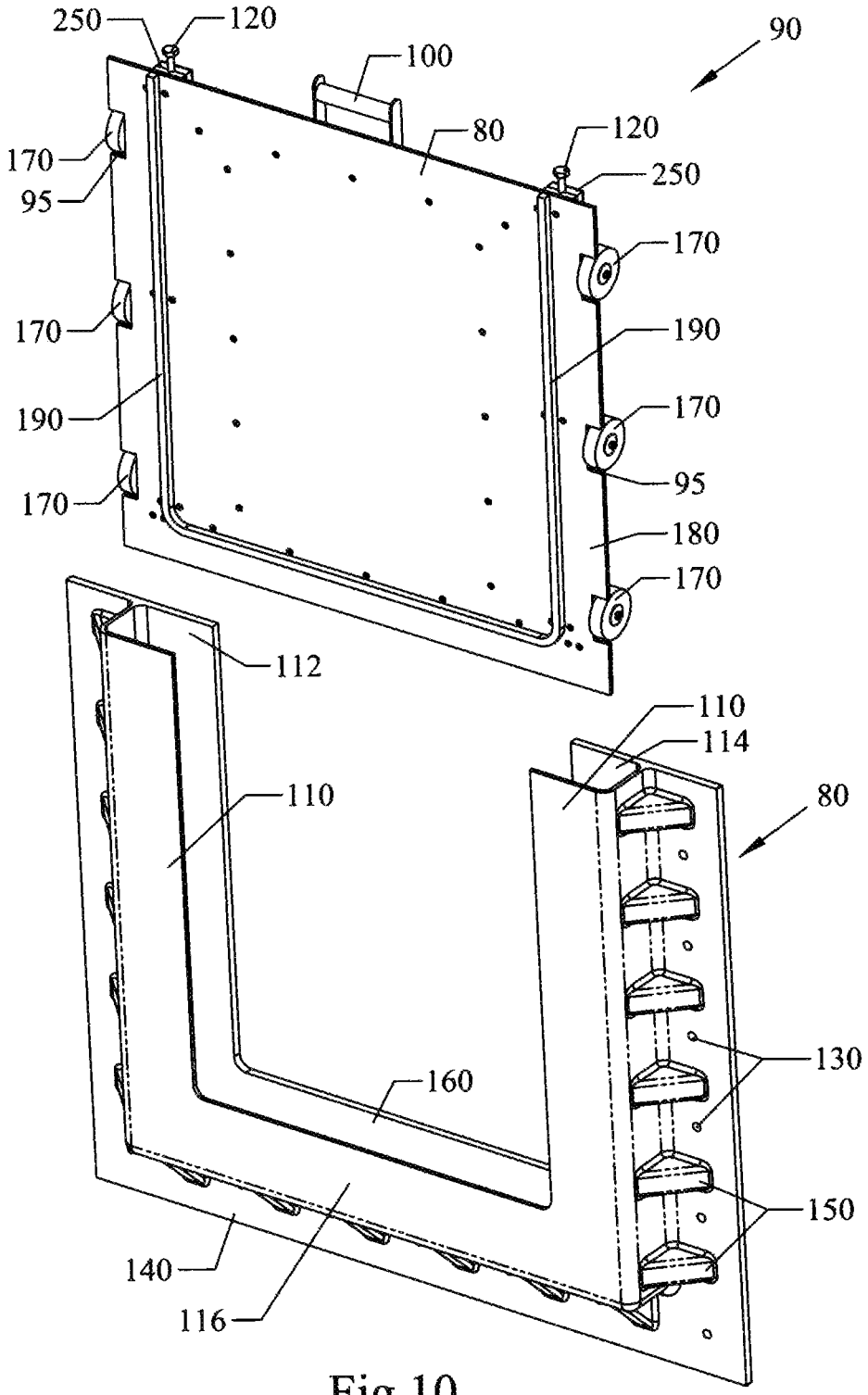
FIG. 10 is a rear perspective view of the damper system of FIG. 5 with damper panel removed.
Figure 12:
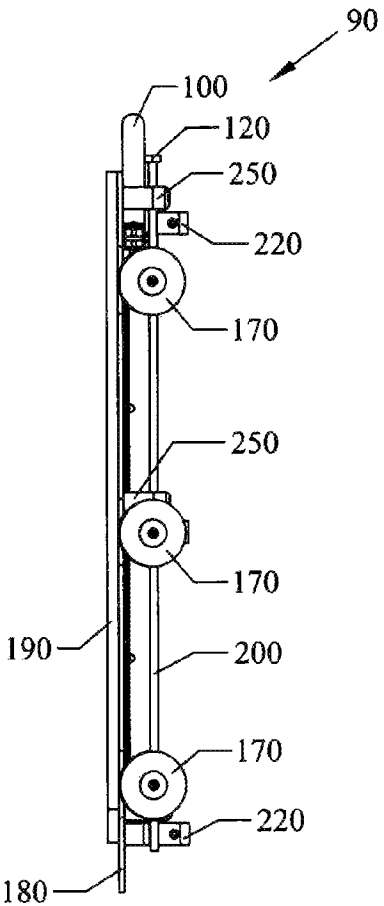
FIG. 12 is a side view of the damper panel of FIG. 11.
Figure 11:
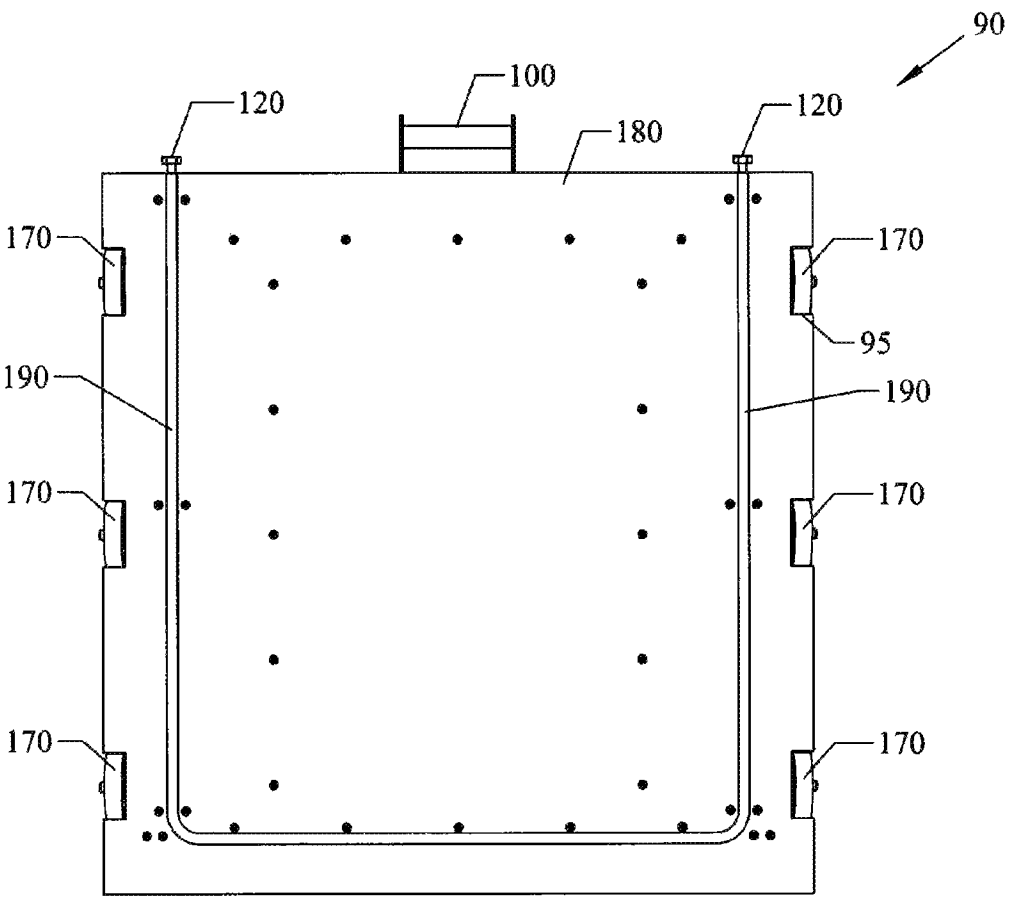
FIG. 11 is a rear view of the damper panel used in the damper system of FIG. 5.
Figure 13:
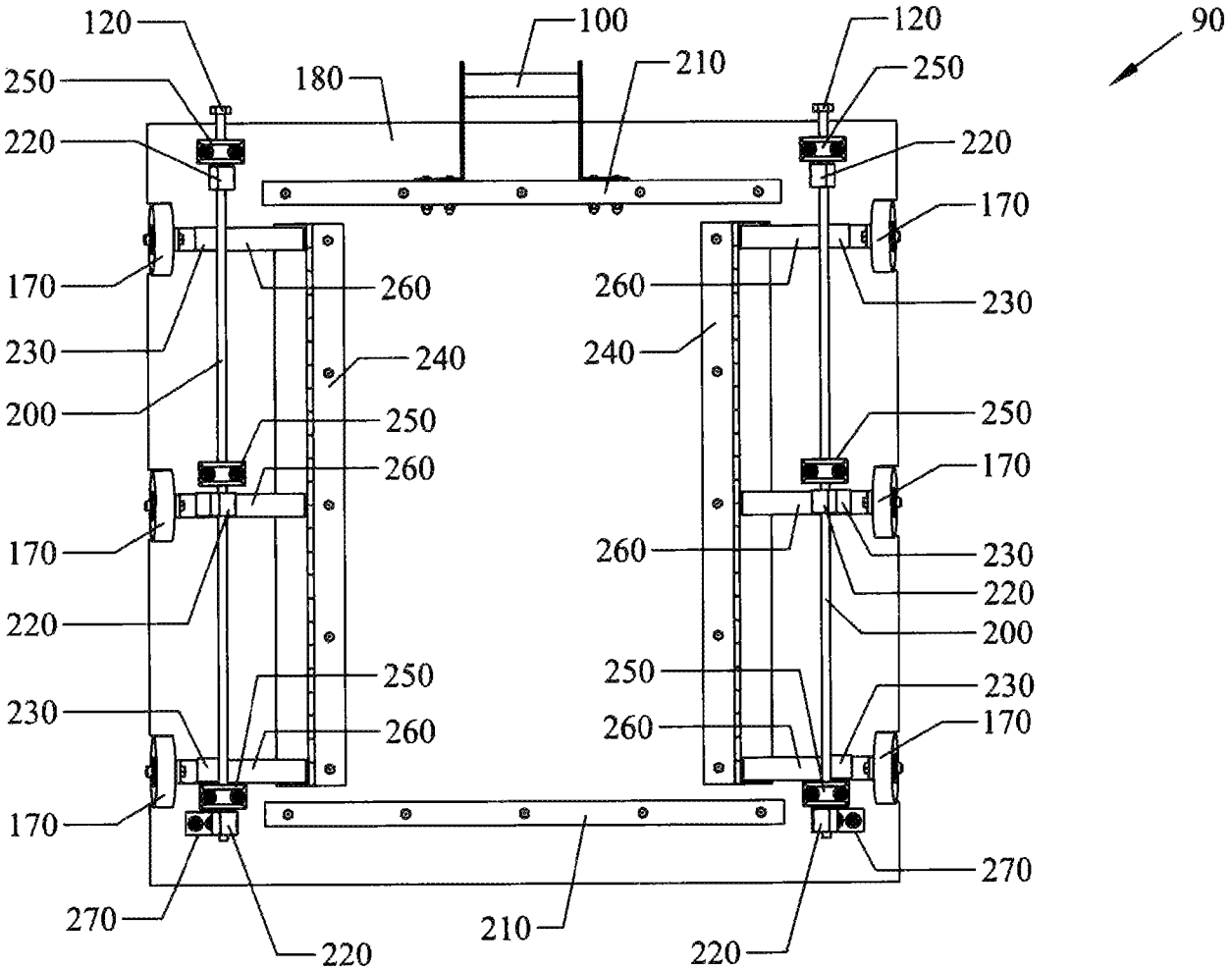
FIG. 13 is a front view of damper panel of FIG. 11.

FIG. 9 is a front perspective view of the damper system 50 of FIG. 5 with damper panel assembly 90 removed from the frame 80. FIG. 10 is a rear perspective view of the damper system 50 of FIG. 5 with damper panel assembly 90 removed from the frame 80. FIG. 11 is a rear view of the damper panel assembly 90 used in the damper system 50 of FIG. 5. FIG. 12 is a side view of the damper panel assembly 90 FIG. 11, and FIG. 13 is a front view of damper panel assembly 90 of FIG. 11.

Referring to FIGS. 9-13, the novel frame 80 includes a back wall 160 of the frame behind the front wall 110. The damper panel assembly 90 includes a generally rectangular panel 180, having a plurality of articulating panel support wheels along both the right and side edges of the panel 180, with each of the wheels positioned within grooves 95 in the side edges of the panel 180. A preferred embodiment has three wheels 170 each on wheel mount brackets 260 along each of the right and left side edges of the panel 180 that are moveable by wheel toggle locking bars 230. Panel mounted hinges 240 are located along both the right and left sides of the panel 180 on which the wheel brackets 260 are affixed and which allow the wheels 170 to articulate.

A foam rubber panel seal 190 having a continuous U shaped configuration can be located on the rear side of the panel 180, and in operation can provide a water seal between panel 180 and the rear wall 160 of the frame 80. Handle 100 can have a base attached by fasteners, such as screws, bolts, and rivets to a damper panel stiffener brace 210.

A lock release rod 200 can have an upper end with a damper panel release hex 120 that allows the rod 200 to be rotated clockwise or counterclockwise. The rod 200 can pass through three lock release rod mount blocks 250 that are arranged on both the left and right sides of the panel 180. A pair of damper panel cam-locks 220 can be arranged on both the left and right sides of the panel and can be controlled by the rotatable rod 200. Stop blocks 270 can be used to prevent cam over-travel in locked or unlocked configurations, and which will be described in further detail below.

As discussed the frame 80 has a left channel track 112, and right channel track 114 and lower channel 116 that are formed between a front wall 110 and a rear wall 160. Angled frame gussets 150 add strength support to the channels 112, 114, 116, and holes 130 are used for fasteners to mount the frame 80 to an inner vault wall 40A.

Figure 14:
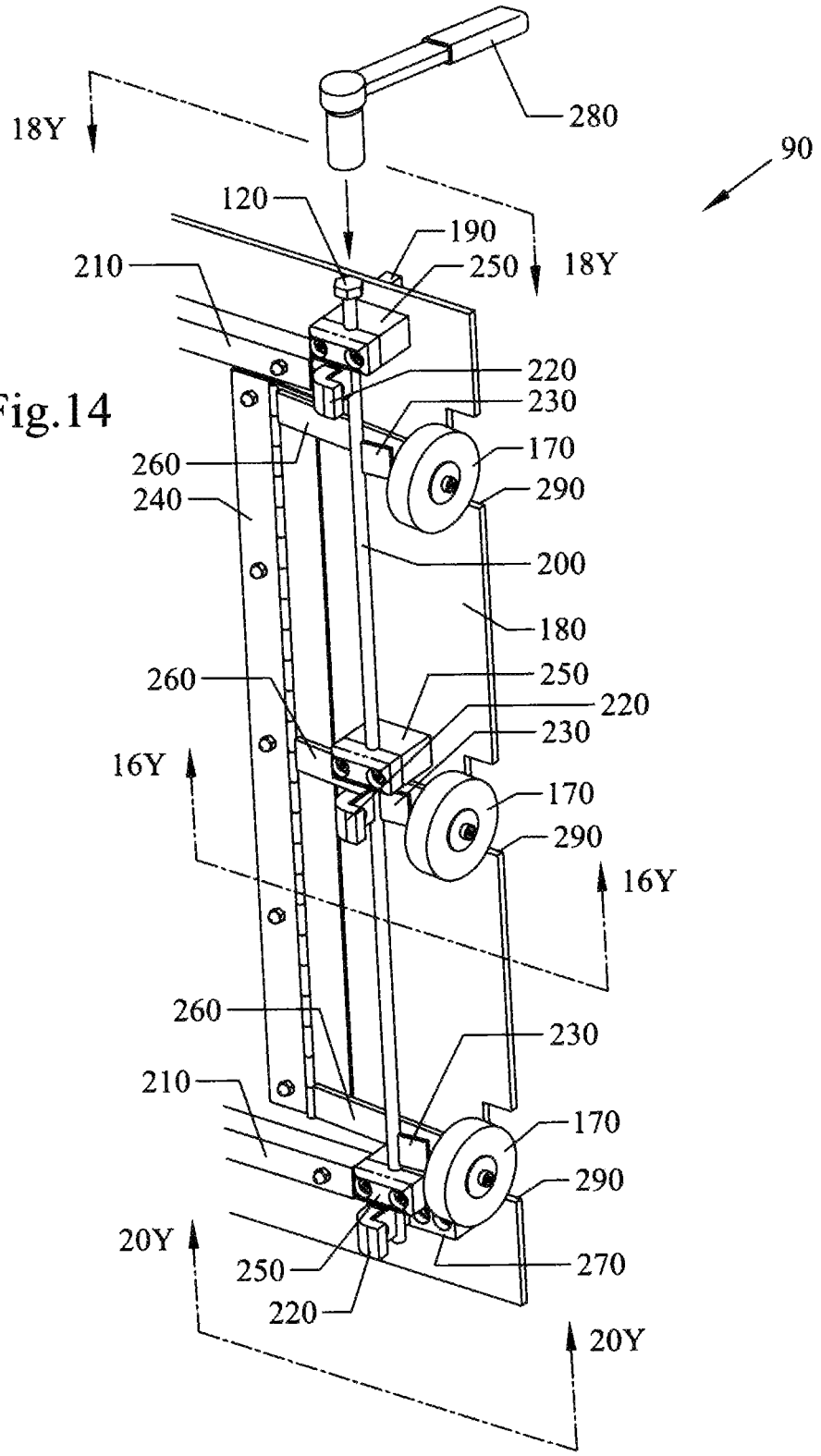
FIG. 14 is a perspective enlarged view of the panel locking system of the damper system of FIG. 5 in a locked configuration.
Figure 15:
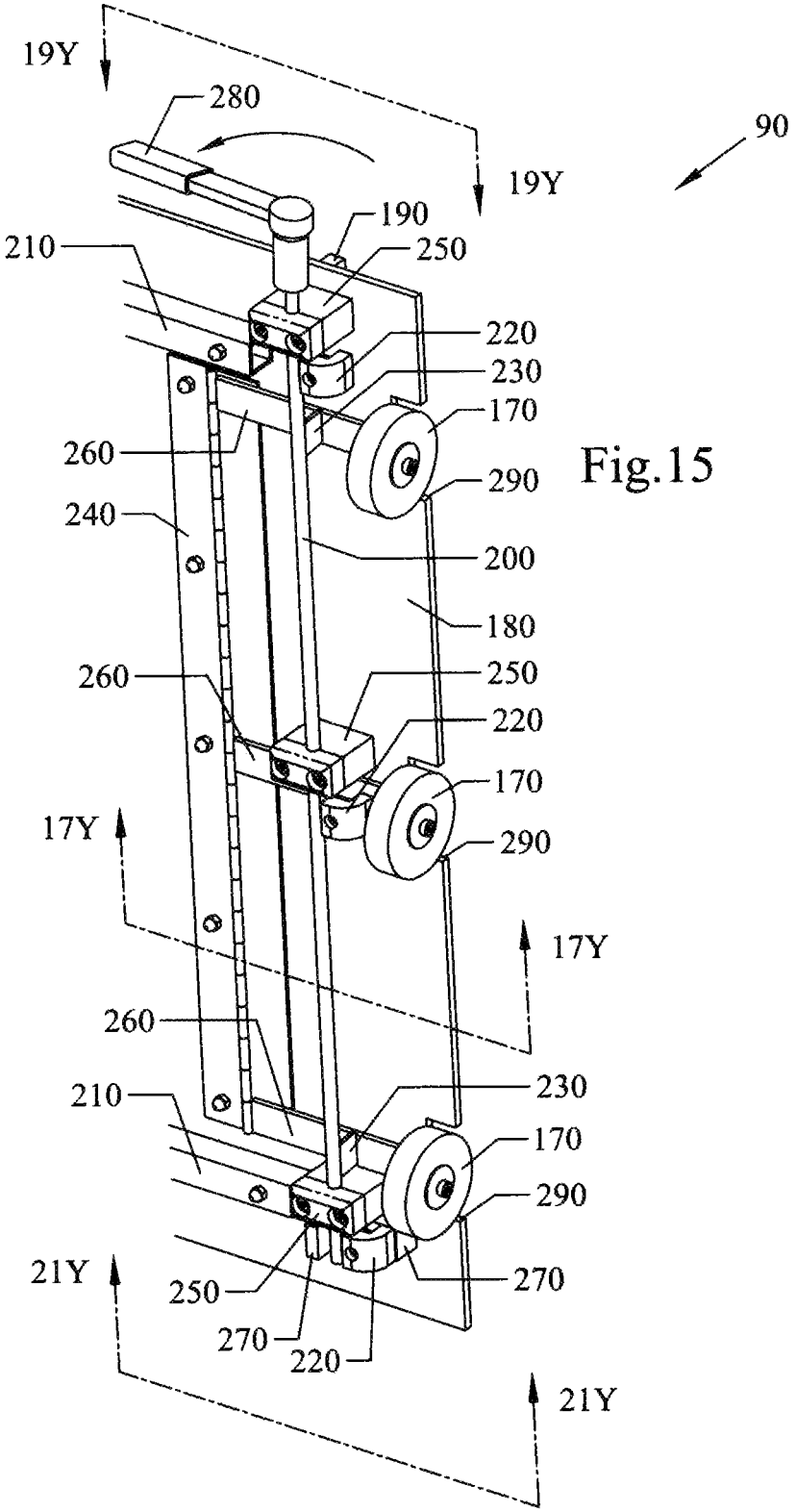
FIG. 15 is a perspective enlarged view of the panel locking system of FIG. 14 in an unlocked configuration.
Figure 16:
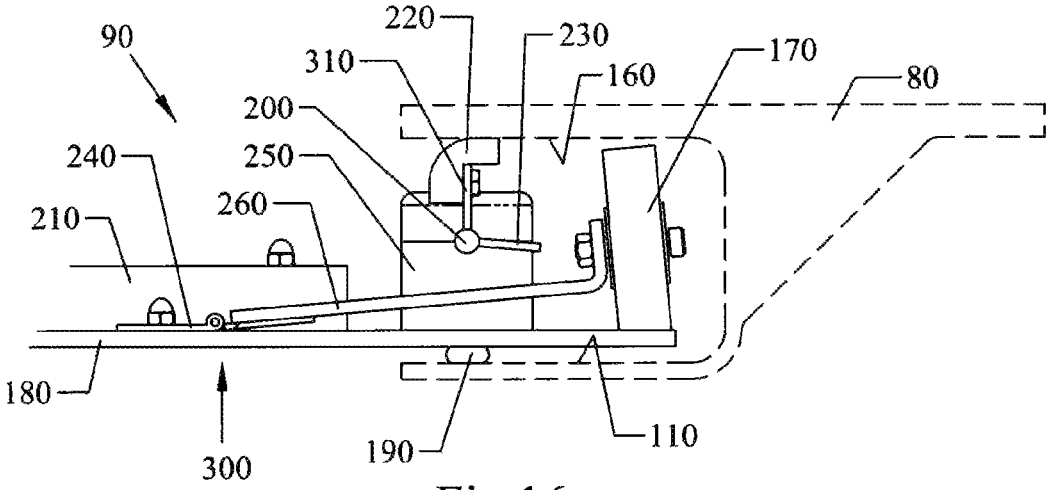
FIG. 16 is a top view of the panel locking system of FIG. 14 along arrows 16Y in a locked configuration.
Figure 17:
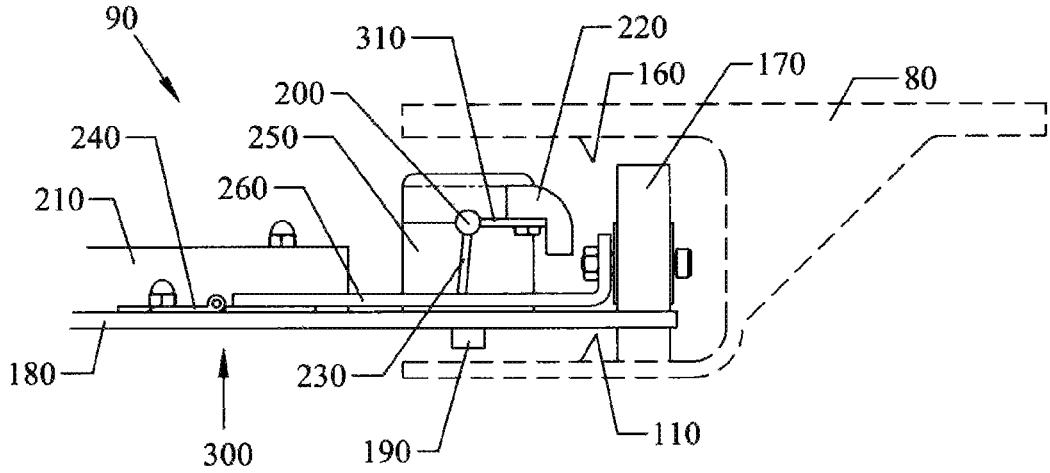
FIG. 17 is a top view of the panel locking system of FIG. 15 along arrows 17Y in an unlocked configuration.
Figure 18:
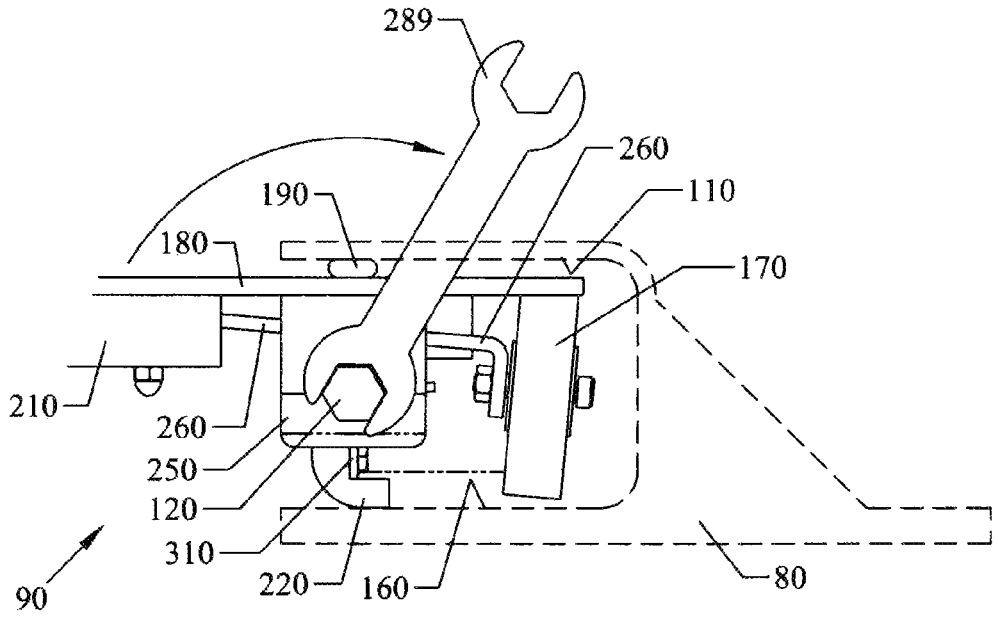
FIG. 18 is a top view of the panel locking system of FIG. 14 along arrows 18Y showing an open-ended wrench being used to lock the panel into the panel frame.
Figure 19:
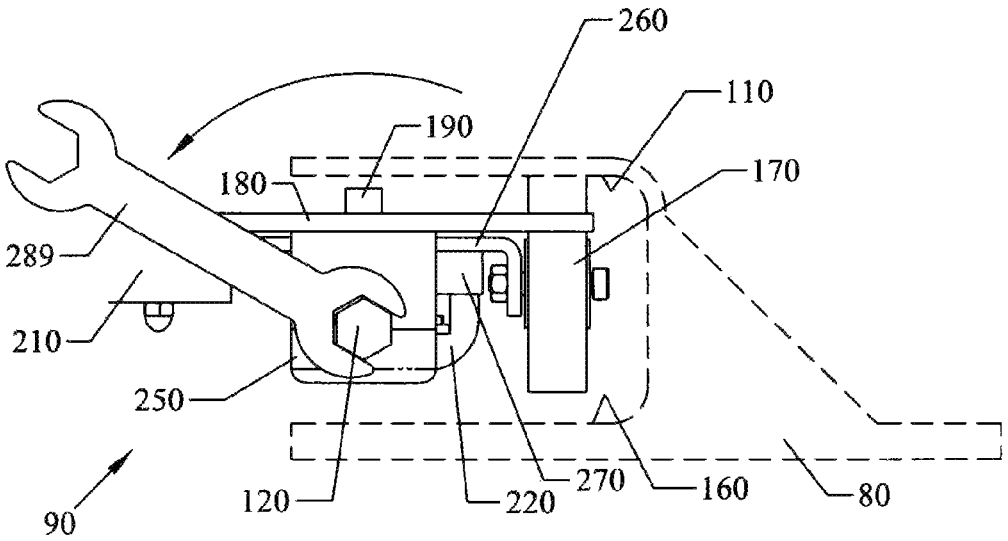
FIG. 19 is a top view of the panel locking system of FIG. 18 along arrows 19Y showing open-ended wrench being used to unlock the panel from the panel frame.
Figure 20:
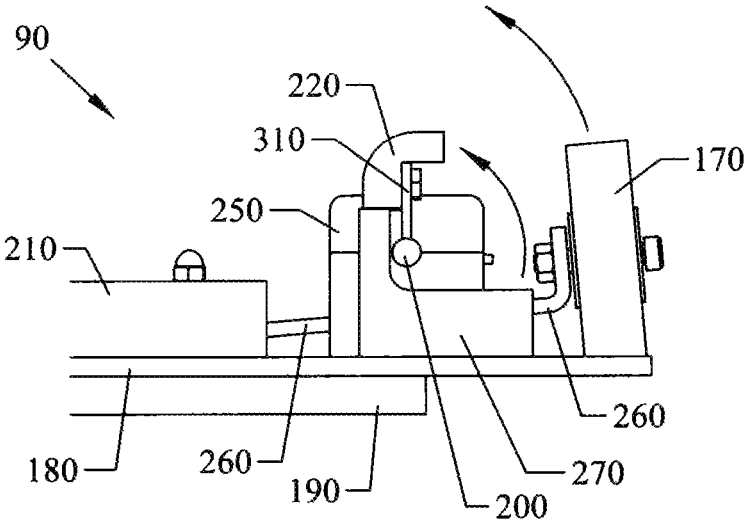
FIG. 20 is a bottom view of the panel locking system of FIG. 14 along arrows 20Y showing the stop-block arresting the counter-clockwise motion of the cam.
Figure 21:
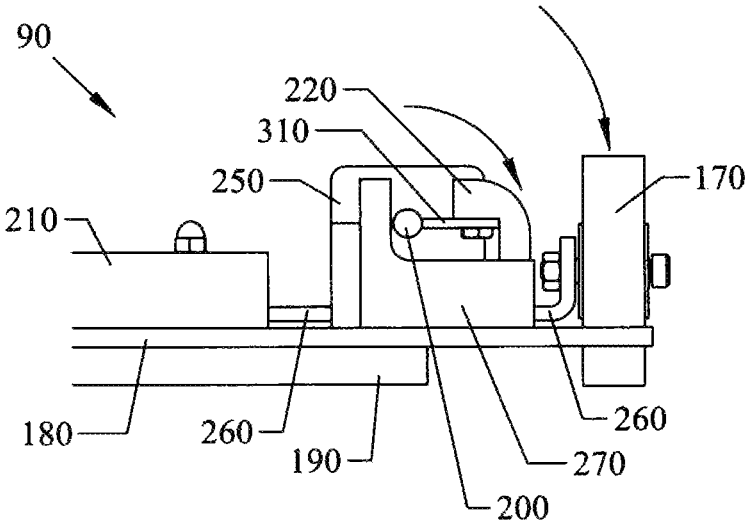
FIG. 21 is a bottom view of the panel locking system of FIG. 20 along arrows 21Y showing the stop-block arresting the clockwise motion of the cam.

FIG. 14 is a perspective enlarged view of the panel locking system of the damper system 50 of FIG. 5 in a locked configuration. FIG. 15 is a perspective enlarged view of the panel locking system of FIG. 14 in an unlocked configuration with the wrench 280 rotated counter-clockwise. FIG. 16 is a top view of the panel locking system of FIG. 14 along arrows 16Y in a locked configuration. FIG. 17 is a top view of the panel locking system of FIG. 15 along arrows 17Y in an unlocked configuration. FIG. 18 is a top view of the panel locking system of FIG. 14 along arrows 18Y showing an open-ended wrench 280 being used to lock the panel into the panel frame. FIG. 19 is a top view of the panel locking system of FIG. 18 along arrows 19Y showing open-ended wrench 280 being used to unlock the panel 180 from the panel frame 80. FIG. 20 is a bottom view of the panel locking system of FIG. 14 along arrows 20Y showing the stop-block 270 arresting the counter-clockwise motion of the cam lock 220. FIG. 21 is a bottom view of the panel locking system of FIG. 20 along arrows 21Y showing the stop-block 270 arresting the clockwise motion of the cam lock 220.

Referring to FIGS. 14-21, the socket wrench tool 280 can have a socket that fits about damper panel release hex 120 (such as a hex head of a bolt).

FIGS. 14 and 16 show the panel in a lock position with the cam-lock 220 abutting against the front wall 110 of the composite frame 80, and the foam rubber panel seal 190 compressed between the panel 180 and the back wall 160 of the composite frame 80. The articulating support wheel(s) 170 are shown articulated (angled) by the panel mounting hinge 240. Water pressure 300 is shown by an arrow pressing against and exposed surface of the panel 180.

As shown in FIGS. 15, and 17, the socket wrench tool 280 is rotated counter-clockwise on the hex 120, the lock release rod 200 also rotates counter-clockwise rotating the damper panel cam-lock 220 away from front wall 110 of the composite frame 80. The panel 180 becomes spaced apart from the back wall 160 of the composite frame 80 allowing the foam rubber panel seal 190 to expand by being separate from back wall 160.

FIGS. 18 and 19 show a hand wrench 289 attached to damper panel release hex 120 that can be used instead of the socket wrench tool 280 to lock (rotating clockwise) and unlock (rotating counter-clockwise).

FIG. 20 is a bottom view of the panel locking system of FIG. 14 along arrows 20Y showing the stop-block 270 arresting the counter-clockwise motion of the cam-lock 220 with the cam-lock mounting bar 310 welded to the lock release rod 200. FIG. 21 is a bottom view of the panel locking system of FIG. 20 along arrows 21Y showing the stop-block 270 arresting the clockwise motion of the cam-lock 220 with the cam-lock mounting bar 310 welded to the lock release rod 200. In FIG. 21, the outer surface of the wheel(s) 170 extends through the panel cutout(s) 290 to clear the support wheel(s) 170.

FIG. 30 is a side view of the elongated handle remote socket wrench tool 330 used in FIGS. 22, 22A, 23 and 23A. FIG. 30A is an enlarged view of the socket part 340 of the tool 330 of FIG. 30. FIG. 31 is a perspective view of the remote socket wrench tool 330 of FIG. 30. FIG. 31A is an enlarged view of the socket 340 with telescoping tube handle 380 of the tool 330 of FIG. 31. The elongated handle remote socket wrench tool 330 can have a telescoping tube handle with cylindrical type parts that slide in and out of each other extending and reducing the length of the handle of the tool 330. A universal joint 350 between the handle 380 and the socket 340 allows for all-angle operation and versatility and maneuverability of the remote socket wrench tool 330.

Figures 22, 22A:
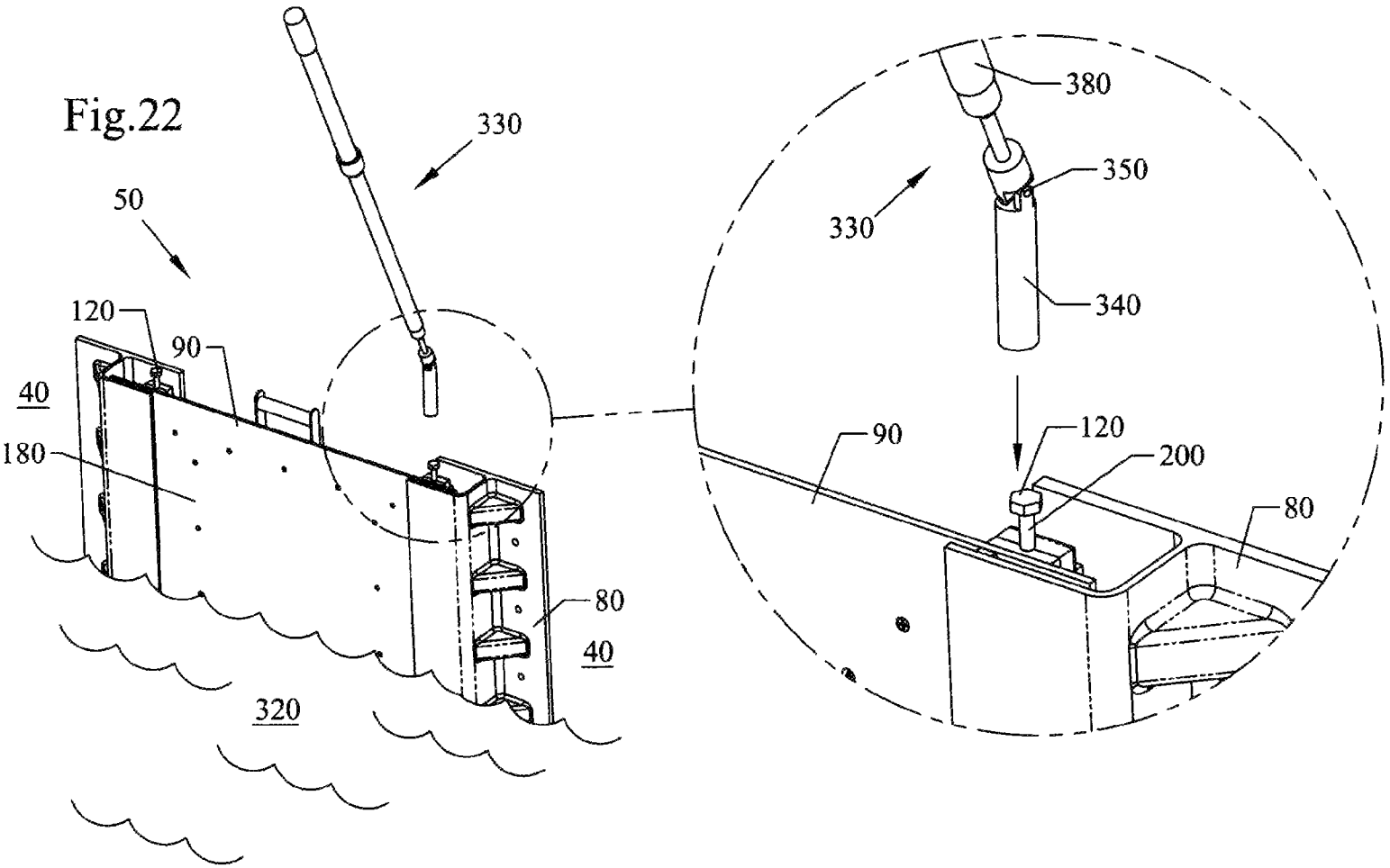
FIG. 22 shows an upper view of the damper panel system in water, with a remote socket wrench tool ready to engage the damper release hex.
FIG. 22A is an enlarged partial view of FIG. 22 showing the socket on the tool ready to engage the damper release hex.
Figures 23, 23A:
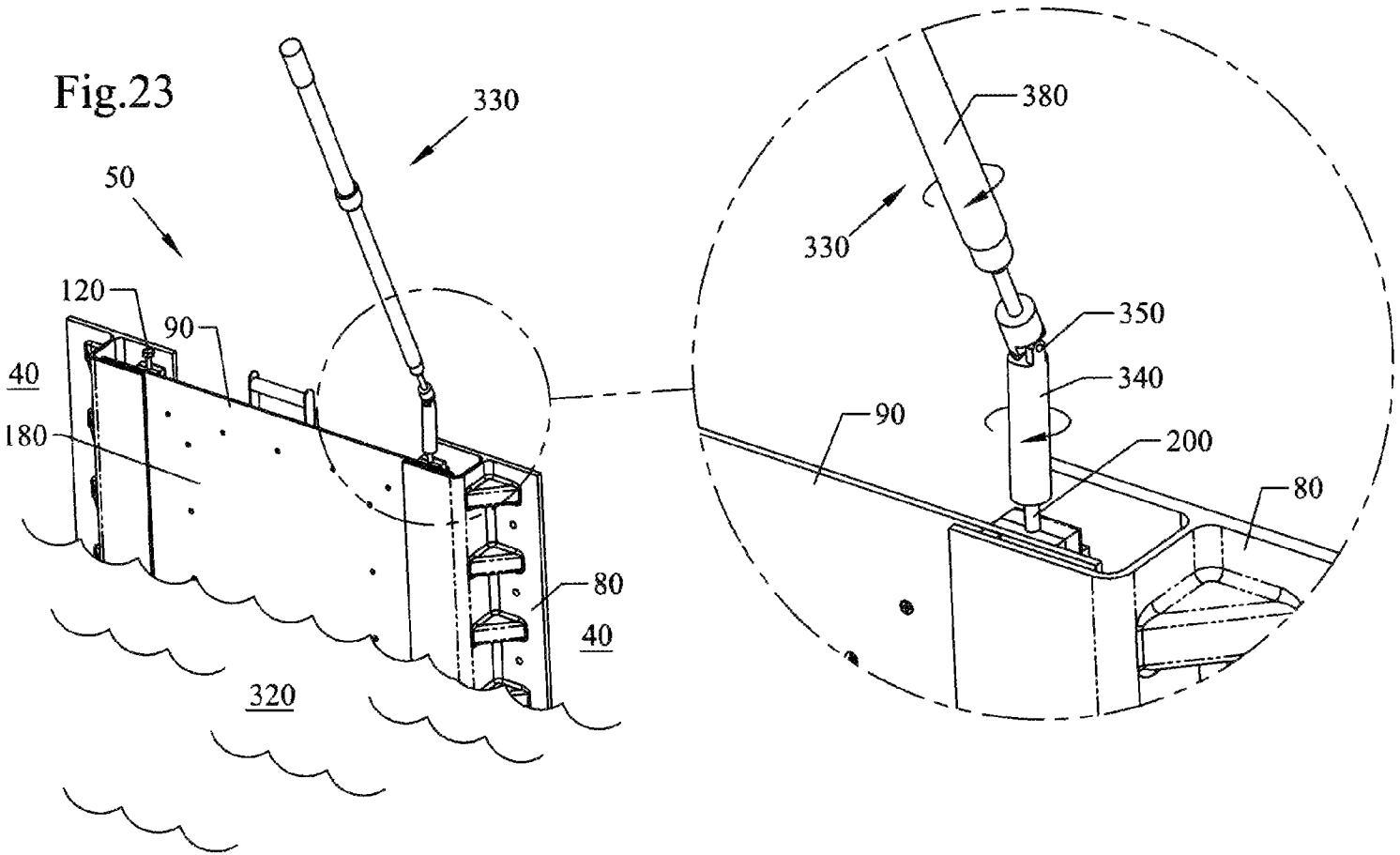
FIG. 23 shows an upper view of the damper panel system in water with a remote socket wrench tool engaged to damper release hex.
FIG. 23A is an enlarged partial view of FIG. 23 showing the socket on the tool ready to unlock the damper release hex.

FIG. 22 shows an upper view of the damper panel system 50 in water, with a remote elongated handle socket wrench tool 330 (of FIGS. 30-31A) ready to engage the damper release hex 120. A universal joint 350 on the elongated tool 330 allows for all angle operation of the elongated remote socket wrench tool 330. FIG. 22A is an enlarged partial view of FIG. 22 showing the socket 340 on the tool 330 ready to engage the damper release hex 120. FIG. 23 shows an upper view of the damper panel system 50 in water 320 with the elongated remote socket wrench tool 330 engaged to damper release hex 120. Clockwise turn of tool unlocks panel 180 from panel frame 80. Counter-clockwise turn locks the panel 180 to the frame 80 FIG. 23A is an enlarged partial view of FIG. 23 shows the socket 340 on the tool 330 ready to unlock the damper release hex 120.

Figure 24:
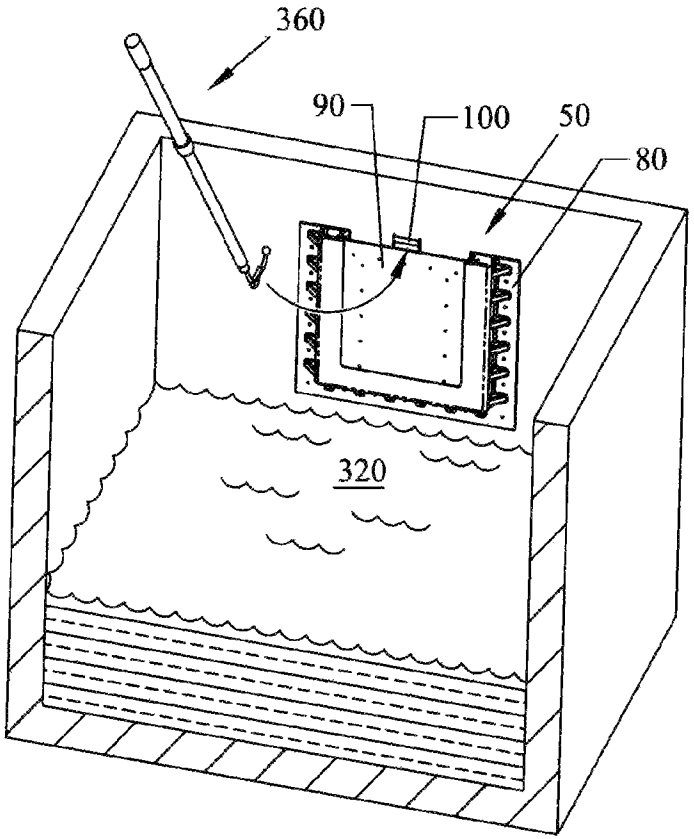
FIG. 24 shows a perspective view of a remote panel lifting hook tool preparing to engage the lift handle on the damper panel that is attached the damper panel system.

FIG. 28 is a perspective view of a hook tool 360 used in FIG. 24. FIG. 28A is an enlarged view of the hook end 400 and ball 390 on the hook tool 360 of FIG. 28. FIG. 29 is a side view of hook tool 360 of FIG. 28. FIG. 29A is an enlarged view of the hook end 400 and ball 390 on the hook tool 360 of FIG. 29.

Figure 25:
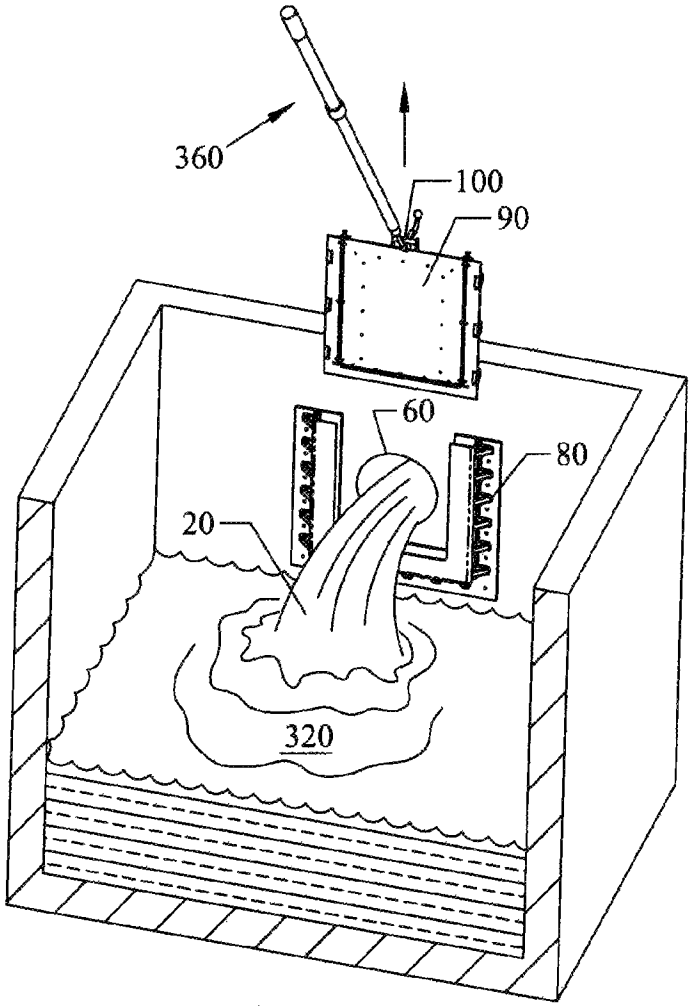
FIG. 25 is another view of FIG. 24 showing the remote panel lifting hook tool lifting the damper panel from the panel frame.

FIG. 24 shows a perspective view of a remote panel lifting hook tool 360 (shown in FIGS. 28-29A) preparing to engage the lift handle 100 on the damper panel assembly 90 that is attached to the composite frame 80 after the panel assembly is in an unlocked position. The ball 390 on the hook end 400 is inserted through the extended handle 100 hooking the handle 100. FIG. 25 is another view of FIG. 24 showing the remote panel lifting hook tool 360 lifting the damper panel assembly 90 from the panel frame 80. A user (not shown) can raise the hook tool 360 that has the hook end 400 with ball 390 hooked about the handle 100 and clearly lift the panel assembly 90 from the frame and allow storm water inflow 20 into the stormwater 320 inside of the vault.

Figure 27:
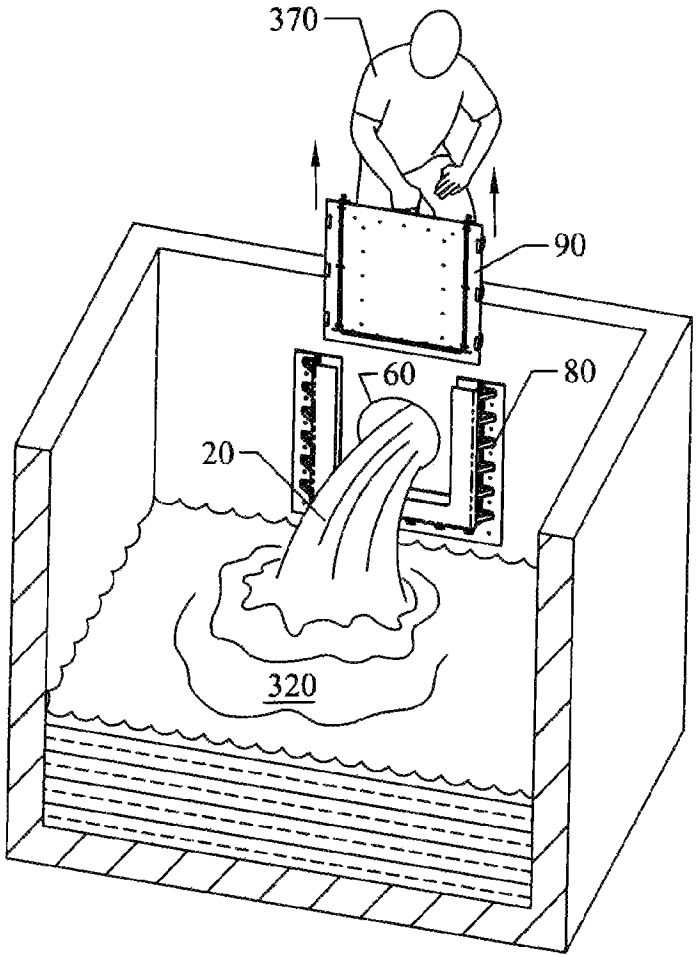
FIG. 27 is another view of FIG. 26 showing the person lifting the damping panel from the frame.
Figure 26:
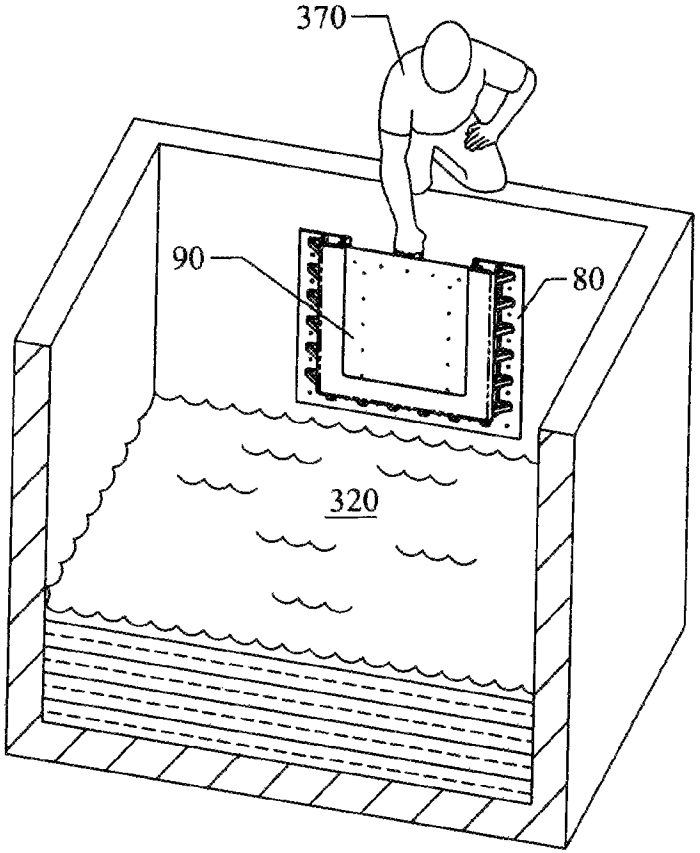
FIG. 26 is a perspective view of a person grasping the damping panel handle preparing to lift the panel from the frame.

FIG. 26 is a perspective view of a person 370 grasping the damping panel handle 100 preparing to lift the panel assembly 90 from the frame 80, after the panel assembly is in an unlocked position. FIG. 27 is another view of FIG. 26 showing the person 370 lifting the damping panel assembly 90 from the frame 80.

Although the figures show the damper panel assembly with frame mounted on the wall of a vault, the invention can be used on other types of walls, such as on dams, and the like.

The foam rubber panel seal 190 can be an elongated seal member, and can be a gasket member such as but not limited to one having a C or E or U type channel that compresses. The seal can also include resilient and/or elastomeric type members, and the seal can be an inflatable bladder type tube(s), and the like. Additionally, the seal 190 can be placed along the bottom edge of the panel as well as the left and right sides of the panel. In a preferred embodiment, the seal member is placed on the opposite side of the panel from the inlet port to the vault or structure.

Although preferred types of lifting tools are described, the invention can use other types of tools for lifting the panel assembly, such as but not limited to using a manhole hook tool, and the like.

While the handle 100 is shown as rectangular, the handle can have other shapes such as triangular, arc shaped, and the like, and can have a catch portion such as an indented or cut-out or lip edge, that can also be snagged or hooked to lift the panel assembly.

Although the invention refers to wrenches, the invention can work with lever arms that are fixably attached to the tops of the cam bars, or are removably attached as needed. Although the invention shows separate rotatable cams in the tracks, a single elongated cam can be used on each side of the panel that can have paddle or wedge shapes. Alternatively, the invention can use removable wedges that when driven into place compress and water seal the damper panel in place.

The invention can incorporate embodiments of the rotating wheels on the doors moving up and down in a track, where the track is in a fixed wall. Alternatively, the invention can have a sliding main primary door, and a secondary door that slides up and down relative to the primary door. The embodiments can have flow over versions so that water can overflow over a sliding door into a vault. Likewise, the embodiments can flow under versions where water flows under a slidable door into a vault. Either or both the primary and secondary doors can slide up in down within tracks with or without rollers and wheels to ease the sliding action of the respective doors.

Figure 34:
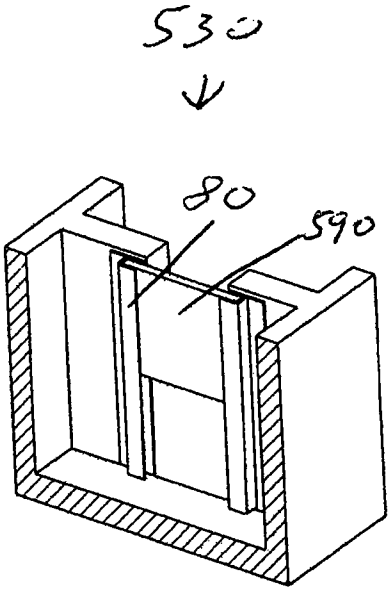
FIG. 34 is a perspective cut-away view of the flow-over door system of FIG. 33 with the door pulled up fully
Figure 33:
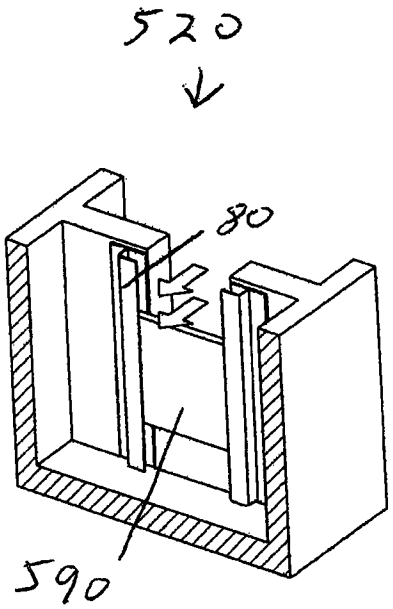
FIG. 33 is a perspective cut-away view of the flow-over door system of FIG. 32 with the door pulled half way up in the door tracks.
Figure 32:
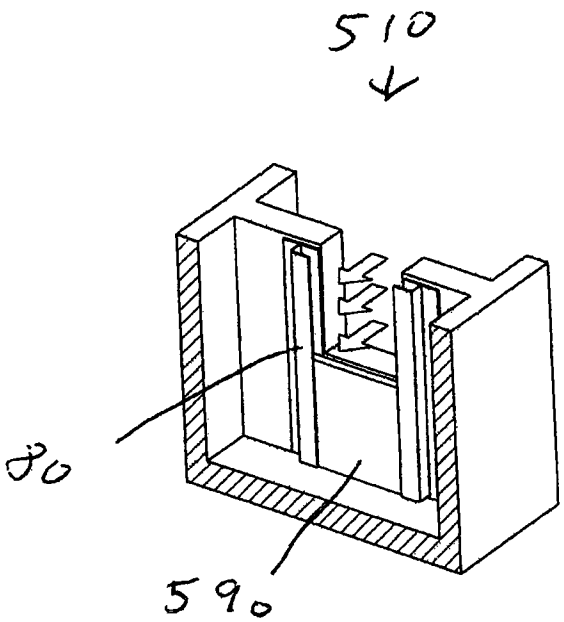
FIG. 32 is a perspective cut-away view of a "flow-over" door system shown with the door down.

FIG. 32 is a perspective cut-away view 510 of a "flow-over" door system shown with the door 590 down. The system is at maximum flow capacity where arrows can represent an overflow into a vault. FIG. 33 is a perspective cut-away view 520 of flow-over door system of FIG. 32 with the door 590 pulled half way up in the door tracks in frame 80. The flow over capacity is cut by half. Further choices of position are possible to adjust flow. The invention can allow for the door to be selectively fixed by the user in different height positions in the tracks. FIG. 34 is a perspective cut-away view 530 of flow-over door system of FIG. 33 with the door 590 pulled up fully Here, the flow is completely cut off from entering into the vault.

Figure 36:
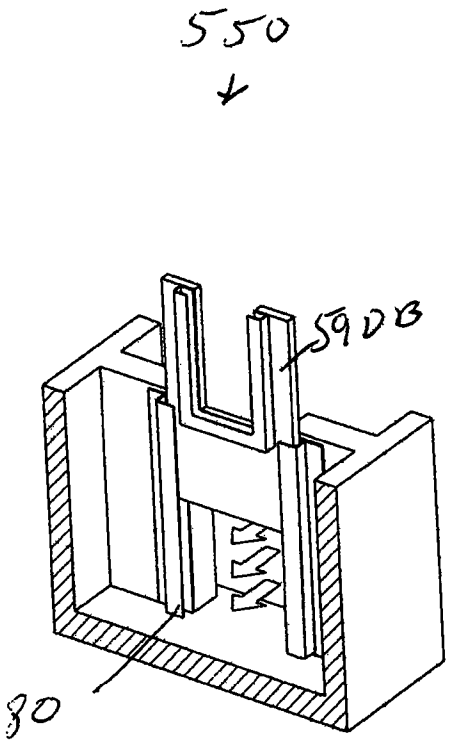
FIG. 36 is a perspective cut-away view of the door-in-a-door system of FIG. 35 with the primary door installed half way.
Figure 35:
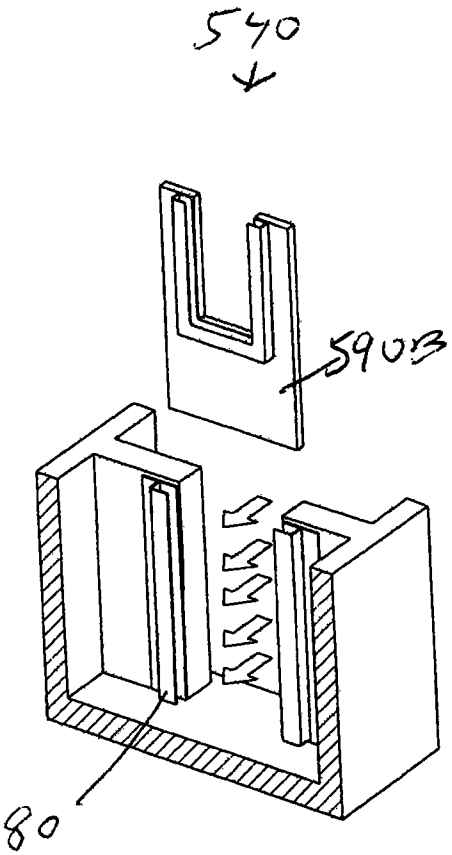
FIG. 35 is a perspective cut-away view of a "door-in-a-door" system with the primary flow through door removed.

FIG. 35 is a perspective cut-away view 540 of "door-in-a-door" system with the primary flow through the opening in the wall with the main (primary) door 590B removed. Here, the system is at maximum flow capacity. FIG. 36 is a perspective cut-away view 550 of the door-in-a-door system of FIG. 35 with the primary door 590B installed half way. System is at about half flow-under capacity. Further choices of position are possible to adjust flow. Similar to the previous embodiment, the primary door 590B can be selectively locked in different height positions within the tracks as needed.

Figure 37:
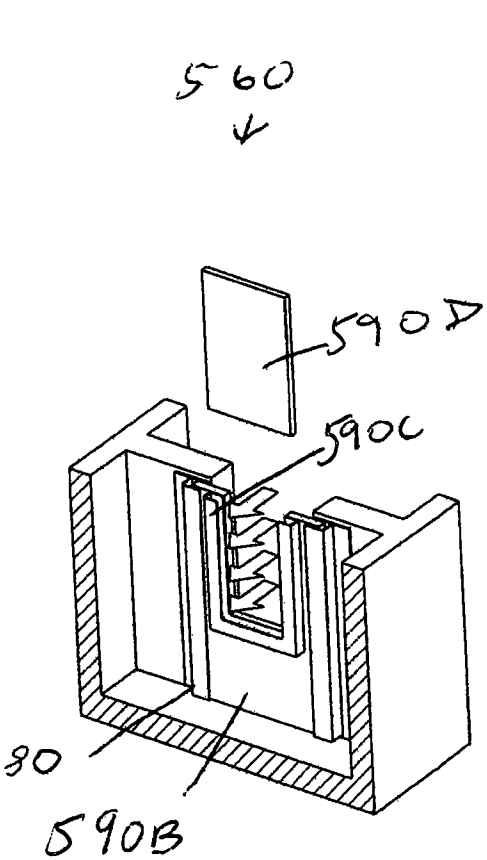
FIG. 37 is a perspective cut-away view of the door-in-a-door system of FIG. 36 with the primary door fully installed.
Figure 39:
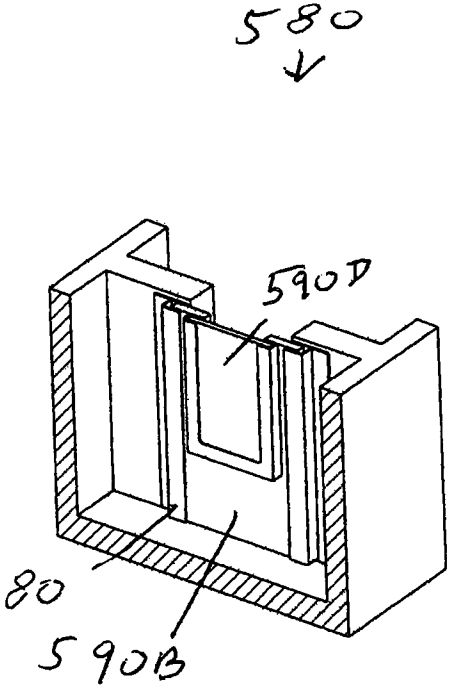
FIG. 39 is a perspective cut-away view of the door-in-a-door system of FIG. 38 with secondary door fully installed.
Figure 38:
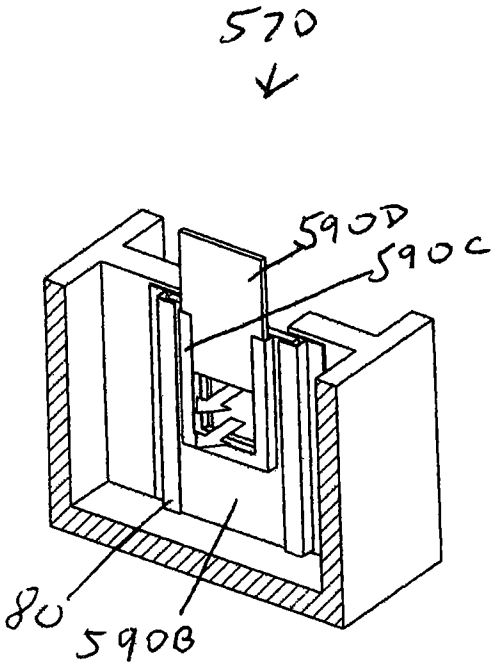
FIG. 38 is a perspective cut-away view of the door-in-a-door system of FIG. 37 with secondary smaller door installed half way.

FIG. 37 is a perspective cut-away view 560 of the door-in-a-door system of FIG. 36 with the primary door 590B fully installed, and the smaller secondary smaller door 590D removed from tracks 590C. Here, the system is at maximum flow-over capacity. FIG. 38 is a perspective cut-away view 570 of door-in-a-door system of FIG. 37 with the secondary smaller door 590D installed half way on tracks 590C. Here, the system is at about half flow-under (secondary) capacity. Further choices of position for the secondary door 590D are possible to adjust flow-over capacity. Similar to the previous embodiment, the secondary door can be selectively locked in different height positions within the tracks as needed. FIG. 39 is a perspective cut-away view 580 of the door-in-a-door system of FIG. 38 with the secondary door 590D fully installed. Here, the flow is completely being cut off.

Although the invention is described for use with storm water treatment vaults and structures, the invention can have other applications, such as but not limited to being used in dam type applications, and the like for ponds, lakes, pools, waterfalls, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A method of providing overflow and underflow conditions through a storm water passage, comprising the steps of:

providing a first door having a length and width that is substantially sized to close off a water passageway, the first door having an opening therethrough;

attaching at least one member to sides of the first door, the at least one member having a loose position in the passageway to allow the first door to move up and down in the passageway, and a wedge position to prevent the first door from moving in the passageway;

providing a second door having a length and width that is substantially sized to close off the opening through the first door; and adjusting the first door and the second door to alternatively allow for water to pass over and under a portion of the passageway.

2. The method of claim 1, further comprising the steps of:

sliding the first door to slide up and down in first tracks about edges of the water passageway; and sliding the second door to slide up and down in second tracks about edges of the opening in the first door.

3. The method of claim 1, further comprising the step of:

adjusting size of the passageway by locking the first door to different height positions in the first tracks.

4. The method of claim 3, further comprising the step of:

adjusting size of the opening in the first door by locking the second door to different height positions in the second tracks.

5. The method of claim 1, further comprising the steps of:

providing first tracks in a first frame in the passageway; and sliding outer side edges of the first door in the first tracks.

6. The method of claim 5, further comprising the steps of:

providing at least one vertical bar member rotatable mounted to a bar mount adjacent to at least one of the outer side edges of the first door;

providing a plurality of spaced apart first moveable members along the at least one vertical bar member; and rotating the at least one vertical bar member which rotates the first moveable members in a horizontal axis to push the first door from a loose position where the first door is loosely seated in the first tracks to a closed position where the first door is pushed against the interior portion of the first tracks where the closed position prevents water from passing about the outer sides edges of the first door.

7. The method of claim 6, further comprising the steps of:

sliding the first door up and down in the tracks by rotating the at least one vertical bar member so that the first moveable members are in the loose position;

locking the first door to different height positions in the first frame by rotating the at least one vertical bar member so that the first moveable members are in the lock position; and adjusting size of the passage through the water passageway by the different height positions of the first door.

8. The method of claim 7, further comprising the steps of:

providing first cam members as the first moveable members.

9. The method of claim 6, further comprising the steps of:

providing second tracks in a second frame around the first door opening; and sliding outer side edges of the second door in the second tracks.

10. The method of claim 9, further comprising the steps of:

providing at least one vertical bar member rotatably mounted to a bar mount adjacent to at least one of the outer side edges of the second door;

providing a plurality of spaced apart second moveable members along the at least one vertical bar member adjacent the second door; and rotating the at least one vertical bar member adjacent the second door which rotates the second moveable members in a horizontal axis to push the second door from a loose position where the second door is loosely seated in the second tracks to a closed position where the second door is pushed against the interior portion of the second tracks where the closed position prevents water from passing about the outer sides edges of the second door.

11. The method of claim 10, further comprising the steps of:

sliding the second door up and down in the second tracks by rotating the at least one vertical bar member adjacent the second door so that the second moveable members are in the loose position;

locking the second door to different height positions in the second frame by rotating the at least one vertical bar member adjacent the second door so the second moveable members are in the lock position; and adjusting size of the passage through the opening in the first door by the different height positions of the second.

12. The method of claim 11, further comprising the steps of:

providing first cam members as the first moveable members; and providing second cam members as the second moveable members.

13. The method of claim 10, further comprising the steps of attaching rotatable first wheels to the outer side edges of the first doors:

rotating the first wheels in the first tracks as the first door slides up and down in the first tracks;

attaching rotatable second wheels to the outer side edges of the second door: and rotating the second wheels in the second tracks as the second door slides up and down in the second tracks.

14. A method of providing a double door damper system for storm water conveyance structures, comprising the steps of:

providing a first door with side edges slidable within first tracks in a first frame about a passage through a water conveyance opening;

providing the first door with a first opening therethrough for defining a smaller passage than the passage through the water conveyance opening;

providing a secondary door with side edges slidable within second tracks of a second frame on the first door;

providing a vertical bar member rotatably mounted to at least one bar mount adjacent to the side edges of the second door;

providing a plurality of spaced apart moveable members along the vertical bar member;

pushing the secondary door against an interior portion inside the second tracks by rotating the vertical bar member; and rotating the moveable members in a horizontal axis from a loose position where the secondary door is loosely seated in the second tracks to a closed position where the secondary door is pushed against the interior portion of the second tracks; and locking the secondary door to different height position for adjusting size of the passage through the water conveyance opening.

15. A method of providing overflow and underflow conditions through a storm water passage, comprising the steps of:

providing a first door having a length and width that is substantially sized to close off a water passageway, the first door having an opening therethrough;

providing a second door having a length and width that is substantially sized to close off the opening through the first door;

attaching rotatable wheels to outer edges of at least one of the first door and the second door, the wheels having a retracted loose position and an extended wedge position;

rotating the wheels in the retracted loose position for sliding the at least one of the first door and the second door; and moving the wheels to the extended wedge position to prevent the at least one of the first door and the second door from sliding up and down.

16. The method of claim 15, further comprising the steps of:

attaching the rotatable wheels to outer edges of the first door, the wheels having a retracted loose position and an extended wedge position;

rotating the wheels in the retracted loose position for sliding the first door up and down in the opening in the water passageway; and moving the first wheels to the extended wedge position to prevent the first door from sliding up and down in the water passageway.

17. The method of claim 15, further comprising the steps of:

attaching the rotatable wheels to outer edges of the second door, the wheels having a retracted loose position and an extended wedge position;

rotating the wheels in the retracted loose position for sliding the second door up and down in the opening in the first door; and moving the wheels to the extended wedge position to prevent the second door from sliding up and down in the opening.

* * * * *